US010464647B2

(12) United States Patent
Tokuda

(10) Patent No.: US 10,464,647 B2
(45) Date of Patent: Nov. 5, 2019

(54) OUTBOARD MOTOR AND VESSEL INCLUDING THE SAME

(71) Applicant: YAMAHA HATSUDOKI KABUSHIKI KAISHA, Iwata-shi, Shizuoka (JP)

(72) Inventor: Kota Tokuda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/214,202

(22) Filed: Dec. 10, 2018

(65) Prior Publication Data

US 2019/0185124 A1 Jun. 20, 2019

(30) Foreign Application Priority Data

Dec. 18, 2017 (JP) ..... 2017-242094

(51) Int. Cl.
*B63H 20/02* (2006.01)
*B63H 20/12* (2006.01)
*F02B 61/04* (2006.01)

(52) U.S. Cl.
CPC ..... *B63H 20/02* (2013.01); *B63H 20/12* (2013.01); *F02B 61/045* (2013.01)

(58) Field of Classification Search
CPC ..... B63H 20/02; B63H 20/12; F02B 61/045
See application file for complete search history.

(56) References Cited

U.S. PATENT DOCUMENTS 4,813,896 A 3/1989 Koike et al.
2007/0170775 A1* 7/2007 Uchimura ..... B60T 7/107 303/112
2010/0068953 A1* 3/2010 Ito ..... B63H 21/265 440/86
2011/0281477 A1 11/2011 Inoue et al.
2014/0262578 A1* 9/2014 Calley ..... B62D 61/065 180/210

FOREIGN PATENT DOCUMENTS

JP 2011-235846 A 11/2011
JP 2014-177173 A 9/2014
JP 6069048 B2 1/2017

* cited by examiner

*Primary Examiner* — Stephen P Avila
(74) *Attorney, Agent, or Firm* — Keating and Bennett, LLP

(57) ABSTRACT

An outboard motor includes an outboard motor main body, a mount, a turning mechanism, an electric actuator, and a controller. The mount attaches the outboard motor main body to a hull. The outboard motor is turnable around a tilt shaft. The turning mechanism turns the outboard motor main body around the tilt shaft to incline the outboard motor main body. The electric actuator supplies a driving force to the turning mechanism. The outboard motor includes an inclination angle sensor that detects an inclination angle of the outboard motor main body. The controller energizes the electric actuator in response to an operation switch and performs energization limiting control to limit energization of the electric actuator when a magnitude of a rate of change of the inclination angle is equal to or less than a predetermined determination threshold for a predetermined duration of time.

14 Claims, 13 Drawing Sheets

OUTBOARD MOTOR AND VESSEL INCLUDING THE SAME

CROSS REFERENCE TO RELATED APPLICATIONS

This application claims the benefit of priority to Japanese Patent Application No. 2017-242094 filed on Dec. 18, 2017. The entire contents of this application are hereby incorporated herein by reference.

BACKGROUND OF THE INVENTION

1. Field of the Invention

The present invention relates to an outboard motor and a vessel including an outboard motor.

2. Description of the Related Art

An outboard motor is a kind of vessel propulsion apparatus that provides a propulsive force to a hull. The outboard motor includes an outboard motor main body, and an attachment mechanism to attach the outboard motor main body to the hull. The attachment mechanism includes a clamp bracket to be fixed to a hull, a tilt shaft attached to the clamp bracket, and a swivel bracket attached turnably to the clamp bracket through the tilt shaft. The outboard motor main body is fixed to the swivel bracket. Accordingly, the outboard motor main body is turnable around the tilt shaft, and therefore, an inclination angle with respect to the clamp bracket (that is, with respect to the hull) is changeable.

For the purpose of tilting-up to raise the outboard motor main body and tilting-down to lower the outboard motor main body, a cylinder is provided between the clamp bracket and the swivel bracket. The cylinder includes a trim cylinder and a tilt cylinder. The trim cylinder is provided to change the inclination angle of the outboard motor main body for the purpose of trim adjustment during traveling of the vessel. The tilt cylinder is provided to tilt-up the outboard motor main body to a withdrawn position on the surface of the water, and tilt-down the outboard motor main body into the water. Hydraulic oil is supplied to these cylinders from a hydraulic pump through a hydraulic path. The hydraulic pump is driven by an electric motor.

Japanese Patent Publication No. 6069048 discloses an arrangement to prevent an electric motor that drives a hydraulic pump from being continuously held in a high-load state. More specifically, an inclination angle of a propulsion apparatus main body with respect to a hull is detected by an inclination angle sensor. When the detected inclination angle is equal to or more than a predetermined upper limit angle, and a current at a predetermined value or more is continuously supplied to an electric motor for a predetermined period of time, a driving force of the electric motor is reduced.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

In the arrangement disclosed in Japanese Patent No. 6069048, when the inclination angle is equal to or more than the upper limit angle, continuation of a high load is determined based on a current flowing in the electric motor, so that an accurate determination and proper control cannot always be performed. For example, a load to be applied to the outboard motor main body during traveling of the vessel is not constant. Moreover, even when the load to be applied to the outboard motor is small, if operating resistance of a turning mechanism that turns the swivel bracket around the tilt shaft is large, the electric motor moves into a high-load state, and a high current flows in the electric motor. Therefore, even when the inclination angle is less than the upper limit angle, the electric motor may be under high load.

In addition, in the arrangement disclosed in Japanese Patent No. 6069048, a circuit to measure a motor current must be provided, and this causes an increase in cost. Further, current measurement involves large errors, and from this viewpoint as well, an accurate determination and proper control are difficult.

In order to overcome the previously unrecognized and unsolved challenges described above, preferred embodiments of the present invention provide outboard motors that reliably limit energization of electric actuators when a load to incline the outboard motor main bodies is high and, accordingly, an inclination angle of the outboard motor main bodies cannot be substantially changed, and a vessel including such an outboard motor.

A preferred embodiment of the present invention provides an outboard motor including an outboard motor main body, a mount, a turning mechanism, an electric actuator, and a controller. The mount includes a fixed member to be fixed to a hull and a tilt shaft joined to the fixed member, and attaches the outboard motor main body to the hull such that the outboard motor main body is turnable around the tilt shaft. The turning mechanism turns the outboard motor main body around the tilt shaft to incline the outboard motor main body with respect to the fixed member. The electric actuator supplies a driving force to the turning mechanism. The outboard motor further includes an inclination angle sensor that detects an inclination angle of the outboard motor main body with respect to the fixed member. The controller is configured or programmed to actuate the turning mechanism by energizing the electric actuator in response to an operation switch that is operated by an operator to change the inclination angle. The controller is further configured or programmed to perform an energization limiting control to limit energization of the electric actuator when a magnitude of a rate of change of the inclination angle detected by the inclination angle sensor is equal to or less than a predetermined determination threshold for a predetermined duration of time. Limiting the energization includes reducing the energizing current as well as stopping the energization.

With the above-described structure, in response to an operator operating an operation switch, the electric actuator is energized to actuate the turning mechanism. Accordingly, the outboard motor main body turns around the tilt shaft, and an inclination angle of the outboard motor main body changes. The inclination angle is detected by the inclination angle sensor. The controller limits energization of the electric actuator when a magnitude of a rate of change of the inclination angle is equal to or less than a predetermined determination threshold for a predetermined duration of time. Accordingly, energization of the electric actuator is limited when a load to incline the outboard motor main body is high and the inclination angle of the outboard motor main body is not able to be sufficiently changed.

A magnitude of the rate of change of the inclination angle takes a value that reflects a variation in the load applied to the outboard motor main body during traveling of the vessel, the operating resistance of the turning mechanism, etc., and accurately reflects an actual load applied to the electric actuator. In addition, the rate of change of the inclination angle is accurately obtained, and does not involve large errors unlike in the case of current measurement. Thus, an arrangement to measure the current is not necessary. Therefore, energization of the electric actuator is reliably limited as necessary with an inexpensive structure.

In a preferred embodiment of the present invention, the controller is configured or programmed to perform the energization limiting control based on a condition that the inclination angle detected by the inclination angle sensor is at a value within an energization limiting region determined in advance. With this configuration, energization limiting control is applied to the electric actuator only in the energization limiting region determined in advance. Accordingly, limiting the energization of the electric actuator is more properly performed.

In a preferred embodiment of the present invention, the energization limiting region includes a region near a boundary value of a trim range determined in advance. With this configuration, when a state in which the magnitude of the rate of change of the inclination angle is small continues near the boundary value of the trim range, energization of the electric actuator is limited. Accordingly, proper limited energization near the boundary value of the trim range is possible, and the electric actuator is prevented from being held in a high-load state for a long period of time.

In a preferred embodiment of the present invention, the energization limiting region includes a portion of the trim range defined between an upper limit boundary value and a lower limit boundary value. The trim range is, for example, a range of the inclination angle of the outboard motor main body when the outboard motor generates a propulsive force during traveling of the vessel. Therefore, for example, when a large reaction force is applied to the outboard motor main body from the surrounding water during traveling of the vessel, energization of the electric actuator is limited.

In a preferred embodiment of the present invention, the energization limiting region includes an up trim limiting region of not less than a first intermediate value between the upper limit boundary value and the lower limit boundary value. With this configuration, in the up trim limiting region of not less than the first intermediate value, energization limiting control based on a rate of change of the inclination angle is performed. Accordingly, energization of the electric actuator is limited when the inclination angle of the outboard motor main body increases during traveling of the vessel and a state in which a high load applied to the electric actuator continues.

In a preferred embodiment of the present invention, the energization limiting region includes a down trim limiting region of not more than a second intermediate value between the upper limit boundary value and the lower limit boundary value. The second intermediate value may be a value smaller than the first intermediate value. With this configuration, in the down trim limiting region of not more than the second intermediate value, energization limiting control based on a rate of change of the inclination angle is performed. Therefore, when a state in which a load applied to the electric actuator continues to be high due to approaching the lower limit of the inclination angle, energization of the electric actuator is limited.

In a preferred embodiment of the present invention, the controller is configured or programmed to energize the electric actuator while the operation switch is operated.

In a preferred embodiment of the present invention, the controller is configured or programmed to, when the operation switch is operated, continue energization of the electric actuator even after the operation of the operation switch ends.

In a preferred embodiment of the present invention, the operation switch includes an up switch to increase the inclination angle and a down switch to reduce the inclination angle. The controller is configured or programmed to perform up energization control to energize the electric actuator so as to increase the inclination angle when the up switch is operated, and perform down energization control to energize the electric actuator so as to reduce the inclination angle when the down switch is operated.

In a preferred embodiment of the present invention, the outboard motor further includes a thermal breaker interposed in a power supply path of the electric actuator. The thermal breaker includes a thermosensitive body that is raised in temperature and deformed by high electric power being continuously supplied to the electric actuator, and a contact that shuts off the power supply path in response to the deformation of the thermosensitive body. Generally, when the thermal breaker is once actuated, the power supply path cannot be recovered until the thermosensitive body has cooled down. In this preferred embodiment of the present invention, when a high-load state of the electric actuator continues, energization of the electric actuator is limited, so that actuation of the thermal breaker is avoided. Therefore, a state in which energization of the electric actuator is possible, that is, a state in which the thermal breaker closes the circuit, is maintained.

In a preferred embodiment of the present invention, the outboard motor main body includes a drive source, a propulsive force generator, and a clutch to turn on/off power transmission between the drive source and the propulsive force generator. The controller is configured or programmed to perform the energization limiting control based on a condition that the clutch is on (in a power transmitting state). The drive source may include an engine (internal combustion engine), or may include an electric motor.

With this configuration, an on state of the clutch is a condition to perform the energization limiting control. When the clutch is on, that is, when the power of the drive source is transmitted to the propulsive force generator, a large external force is applied to the outboard motor main body due to a reaction force from the surrounding water. Accordingly, the load on the electric actuator increases. Therefore, by making it a condition that the clutch is on, energization limiting control based on the rate of change of the inclination angle is properly performed.

In a preferred embodiment of the present invention, the controller is configured or programmed to perform the energization limiting control based on a condition that an output of the drive source of the outboard motor main body is equal to or more than a predetermined value. With this configuration, an output of the drive source being equal to or more than a predetermined value is a condition to perform the energization limiting control. When an output of the drive source is high, a large propulsive force is generated, so that in response to this, a large reaction force is applied to the outboard motor main body from the surrounding water. Therefore, the load on the electric actuator is high. Therefore, by making it a condition that an output of the drive source is equal to or more than a predetermined value, the energization limiting control based on the rate of change of the inclination angle is properly performed.

In a preferred embodiment of the present invention, the electric actuator includes an electric motor and a hydraulic pump to be driven by the electric motor. The turning mechanism includes a hydraulic cylinder to be supplied with hydraulic oil from the hydraulic pump, and a relief valve that opens a bypass oil passage that bypasses the hydraulic cylinder when a load on the hydraulic cylinder exceeds a predetermined value.

With this structure, when the load on the hydraulic cylinder exceeds the predetermined value, the relief valve is actuated, and accordingly, the hydraulic oil passes through the bypass oil passage and circulates. When the electric motor is continuously actuated in this state, not only electric power is wasted, but the electric motor is also continuously driven in a high-load state. On the other hand, due to opening of the relief valve, the hydraulic cylinder is able to provide no further driving force to the turning mechanism, so that the inclination angle of the outboard motor does not substantially change. Accordingly, energization of the electric motor is limited, so that the electric motor is prevented from being held in a high-load state for a long period of time.

A preferred embodiment of the present invention provides a vessel including a hull, an operation switch to be operated by an operator to change the inclination angle, and an outboard motor that includes the above-described features and is attached to the hull. With this structure, when a load to incline the outboard motor main body is high, and the inclination angle of the outboard motor main body cannot be changed by much, energization of the electric actuator is reliably limited.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
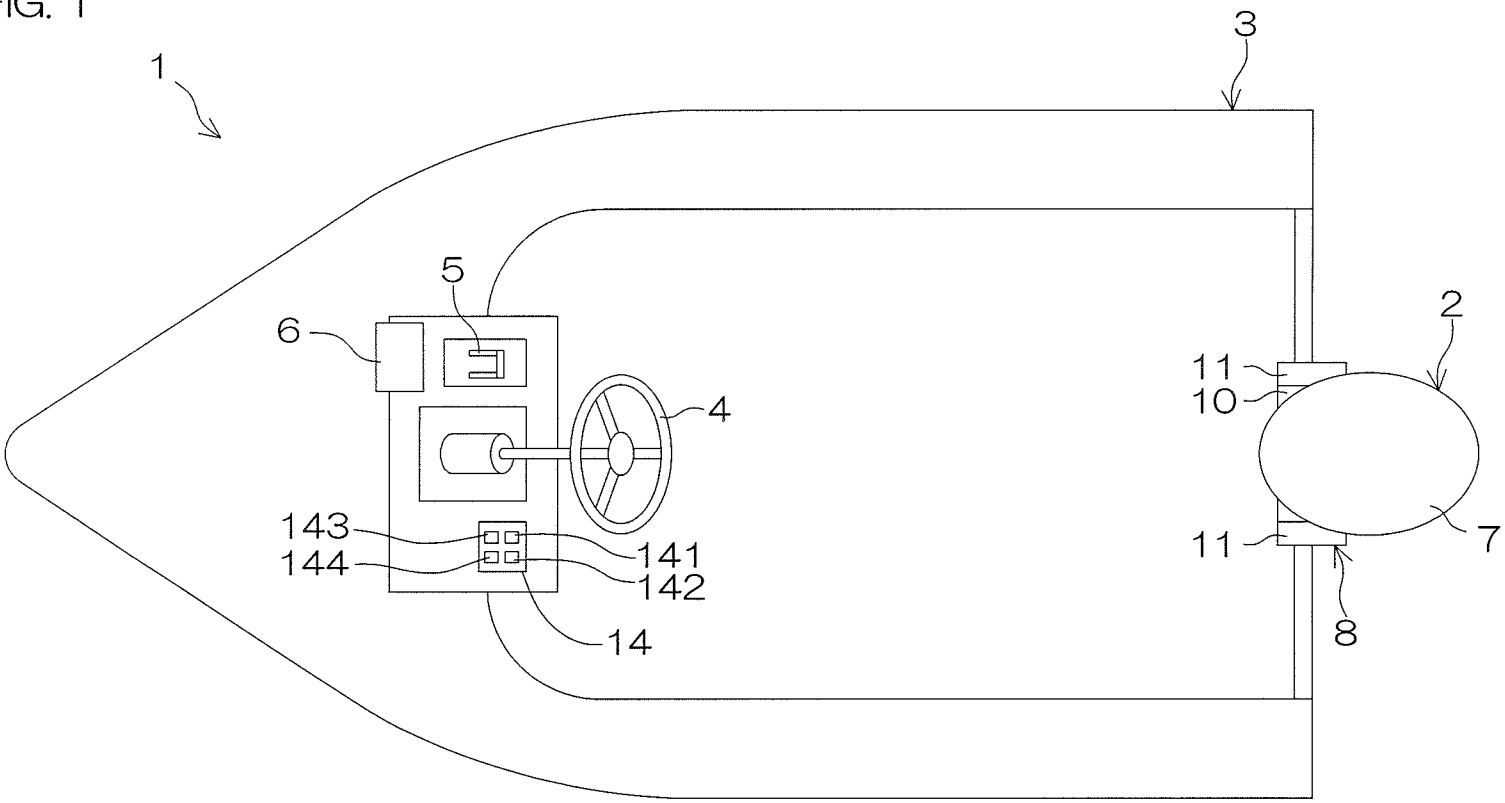
FIG. 1 is a conceptual diagram showing a configuration of a vessel according to a preferred embodiment of the present invention.

FIG. 1 is a conceptual diagram showing a configuration of a vessel according to a preferred embodiment of the present invention. A vessel 1 includes an outboard motor 2 and a hull 3. The outboard motor 2 is attached to a rear portion of the hull 3. The hull 3 is propelled by the outboard motor 2. The hull 3 includes a steering wheel 4, an accelerator lever 5, a display 6, and a PTT operation switch 14.

The steering wheel 4 is an operation member to be operated by an operator to steer the vessel 1. The accelerator lever 5 is an operation member to be operated by an operator for shift selection and output adjustment of the outboard motor 2. The shift selection sets a shift position of the outboard motor 2 to any of forward, neutral, and reverse. The output adjustment includes adjustment of a rotation speed of an engine, an example of a drive source of the outboard motor 2. By operating the accelerator lever 5, whether a propulsive force is to be provided to the hull 3 is determined, and a direction of the propulsive force and a magnitude of the propulsive force is adjusted. Therefore, by operating the accelerator lever 5, a traveling direction and a speed of the vessel 1 are adjusted.

Figure 2:
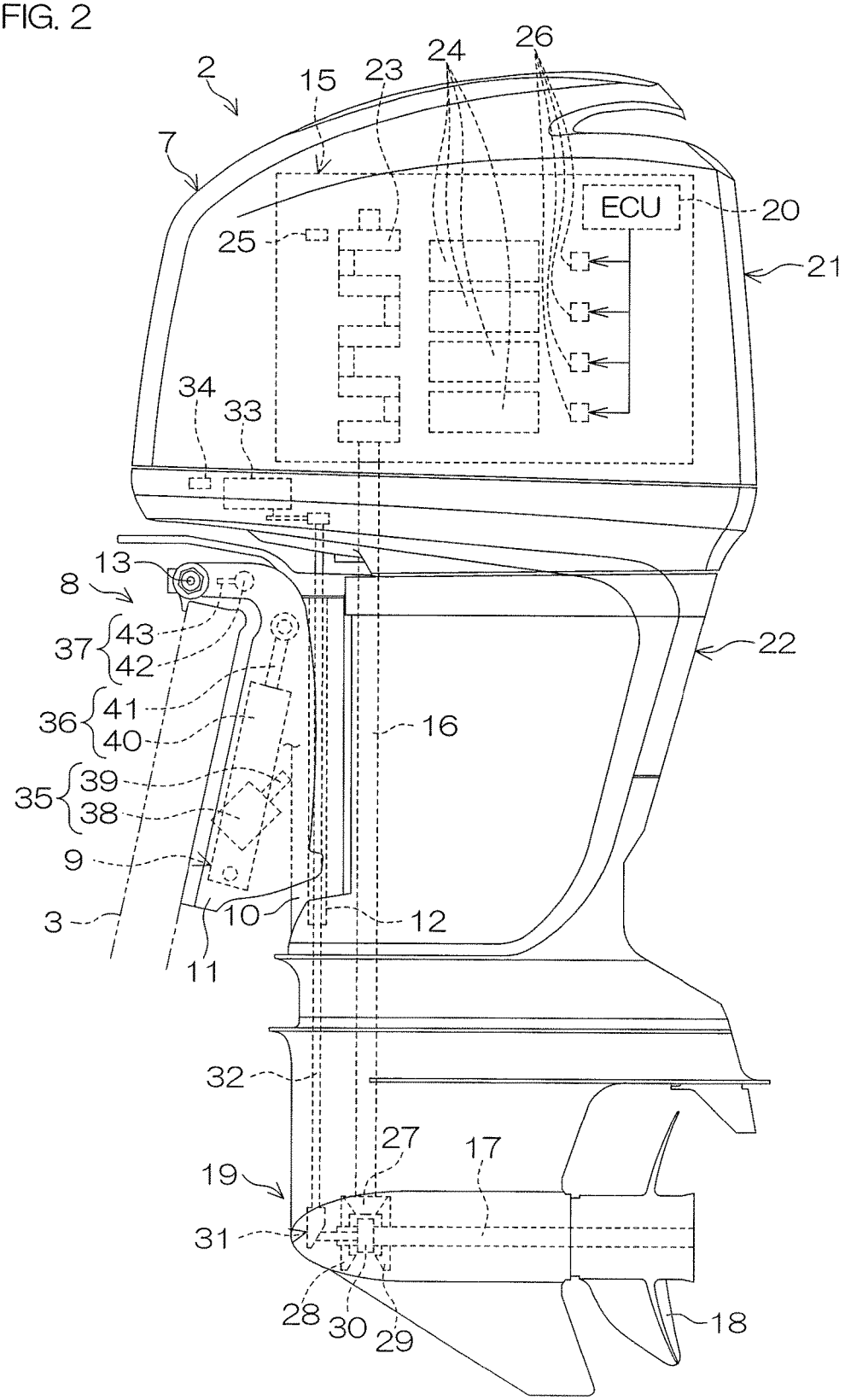
FIG. 2 is a side view showing an example of an outboard motor equipped in the vessel.

FIG. 2 is a side view showing an example of the outboard motor 2. The outboard motor 2 includes an outboard motor main body 7, a mount 8, and a power trim and tilt mechanism 9 (hereinafter, referred to as "PTT mechanism 9"). The outboard motor main body 7 is attached to a rear portion of the hull 3 by the mount 8. The mount 8 includes a swivel bracket 10, a pair of clamp brackets 11, a steering shaft 11, and a tilt shaft 13. The steering shaft 12 extends in an up-down direction. The tilt shaft 13 is oriented horizontally or substantially horizontally and extends in a left-right direction. The swivel bracket 10 is joined to the outboard motor main body 7 through the steering shaft 12. The pair of clamp brackets 11 are an example of a fixed member in a preferred embodiment of the present invention, and are spaced apart from each other in the left-right direction. A portion of the swivel bracket 10 and the PTT mechanism 9 are located between the pair of clamp brackets 11. The PTT mechanism 9 is an example of a turning mechanism that turns the outboard motor main body 7 around the tilt shaft 12 to incline the outboard motor main body 7 with respect to the clamp brackets 11.

The outboard motor main body 7 is attached to the hull 3 by the mount 8 in a vertical or substantially vertical posture. The outboard motor main body 7 and the swivel bracket 10 are able to be turned up and down around the tilt shaft 13 with respect to the clamp brackets 11. The outboard motor main body 7 and the swivel bracket 10 are turned up and down around the tilt shaft 13 by the PTT mechanism 9. The PTT mechanism 9 is actuated by an operation of the PTT operation switch 14 (refer to FIG. 1). Therefore, by operating the PTT operation switch 14, the outboard motor main body 7 is inclined with respect to the clamp brackets 11. Accordingly, an inclination angle of the outboard motor main body 7 with respect to the hull 3 is changed, so that trim adjustment is performed and the outboard motor main body 7 is tilted up/down. The outboard motor main body 7 is able to be turned to the left and right around the steering shaft 12 with respect to the swivel bracket 10. The outboard motor main body 7 is turned to the left or right around the steering shaft 12 by an operation of the steering wheel 4. The vessel 1 is thus steered.

The outboard motor main body 7 includes an engine 15 as an example of a drive source, a driveshaft 16, a propeller shaft 17, a propeller 18 as an example of a propulsive force generator, a forward-reverse switching mechanism 19 as an example of a clutch, and an ECU (electronic control unit) 20 as an example of a controller. The outboard motor main body 7 further includes an engine cover 21 and a casing 22. The engine 15 and the ECU 20 are housed inside the engine cover 21. The driveshaft 16 extends vertically inside the engine cover 21 and the casing 22. The propeller shaft 17 extends in the front-rear direction inside a lower portion of the casing 22. An upper end portion of the driveshaft 16 is joined to the engine 15. A lower end portion of the driveshaft 16 is joined to a front end portion of the propeller shaft 17 by the forward-reverse switching mechanism 19. The propeller 18 is joined to a rear end portion of the propeller shaft 17. The propeller 18 rotates together with the propeller shaft 17. The propeller 18 is driven to rotate by the engine 15.

The engine 15 may be, for example, an internal combustion engine that generates power by combustion of a fuel such as gasoline. The engine 15 includes a crankshaft 23, a plurality (for example, four) of cylinders 24, and a rotation speed detector 25. The engine 15 is located so that the crankshaft 23 extends vertically. The upper end portion of the driveshaft is joined to the crankshaft 23. The crankshaft 23 is driven to rotate around a vertical axis by combustion in the plurality of cylinders 24. A rotation speed of the crankshaft 23 (rotation speed of the engine 15) is detected by the rotation speed detector 25 and the ECU 20. The rotation speed detector 25 outputs a detection signal in synchronization with rotation of the crankshaft 23. The ECU 20 calculates an engine rotation speed based on the detection signal.

The engine 15 includes a plurality of spark plugs respectively attached to the plurality of cylinders 24, and a plurality of ignition coils 26 respectively connected to the plurality of spark plugs. The engine 15 further includes a plurality of intake pipes respectively connected to the plurality of cylinders 24, and fuel injectors and throttle valves provided in the respective intake pipes. The ECU 20 instructs each of the plurality of ignition coils 26 to generate a high voltage. The high voltage is applied to each spark plug to generate a spark discharge inside each cylinder 24. A mixed gas of fuel and air supplied into each cylinder 24 is thus combusted. The ECU 20 controls an opening degree of each throttle valve to adjust a supply flow rate of the mixed gas into each cylinder 24. In addition, the ECU 20 controls the opening degree of the throttle valve and an injection amount of fuel injected from the fuel injector to adjust an air-fuel ratio.

The forward-reverse switching mechanism 19 includes a drive gear 27, a forward drive gear 28, a reverse drive gear 29, a dog clutch 30, and a shift mechanism 31. The drive gear 27, the forward drive gear 28, and the reverse drive gear 29 are, for example, cylindrical bevel gears. The drive gear 27 is located so that its central axis extends vertically. A teeth portion of the drive gear 27 is directed downward. The drive gear 27 is joined to the lower end portion of the driveshaft 16. Also, each of the forward drive gear 28 and the reverse drive gear 29 is located so that its central axis extends to the front and rear, and the front end portion of the propeller shaft 17 is inserted through these gears. The forward drive gear 28 and the reverse drive gear 29 are freely turnable with respect to the propeller shaft 17. The forward drive gear 28 and the reverse drive gear 29 are spaced apart from each other in the front-rear direction, and between these gears, the dog clutch 30 is located and spline-coupled to the propeller shaft 17. Therefore, the dog clutch 30 is slidable in the front-rear direction with respect to the propeller shaft 17, and rotates together with the propeller shaft 17 around a rotation axis extending along the front-rear direction. The drive gear 27 engages with the front drive gear 28 and the reverse drive gear 29, and transmits rotation to these gears. Due to the drive gear 27 rotating, the forward drive gear 28 and the reverse drive gear 29 rotate in directions opposite to each other on the propeller shaft 17.

The dog clutch 30 is moved in an axial direction of the propeller shaft 17 by the shift mechanism 31. The shift mechanism 31 includes, for example, a shift rod 32 extending vertically, a shift actuator 33 joined to an upper end portion of the shift rod 32, and a shift position detector 34 that detects a shift position of the dog clutch 30. Due to the shift rod 32 being turned by the shift actuator, the dog clutch 30 moves in the axial direction on the propeller shaft 17.

The shift mechanism 31 is actuated in response to an operation of the accelerator lever 5, and locates the dog clutch 30 at any shift position of a forward position, a reverse position, and a neutral position. The forward position is a position at which the dog clutch 30 engages with the forward drive gear 28, and the reverse position is a position at which the dog clutch 30 engages with the reverse drive gear 29. The neutral position is a position at which the dog clutch 30 engages with neither of the gears 28 and 29. When the shift position is at the forward position, rotation of the driveshaft 16 is transmitted from the forward drive gear 28 to the propeller shaft 17 through the dog clutch 30. Accordingly, the propeller 18 rotates in a forward direction together with the propeller shaft 17. When the shift position is at the reverse position, rotation of the driveshaft 16 is transmitted from the reverse drive gear 29 to the propeller shaft 17 through the dog clutch 30. Accordingly, the propeller 18 rotates in a reverse direction together with the propeller shaft 17. When the shift position is at the neutral position, both of the forward drive gear 28 and the reverse drive gear 29 idle on the propeller shaft 17, and rotation of the driveshaft 16 is not transmitted to the propeller shaft 17.

Figure 3:
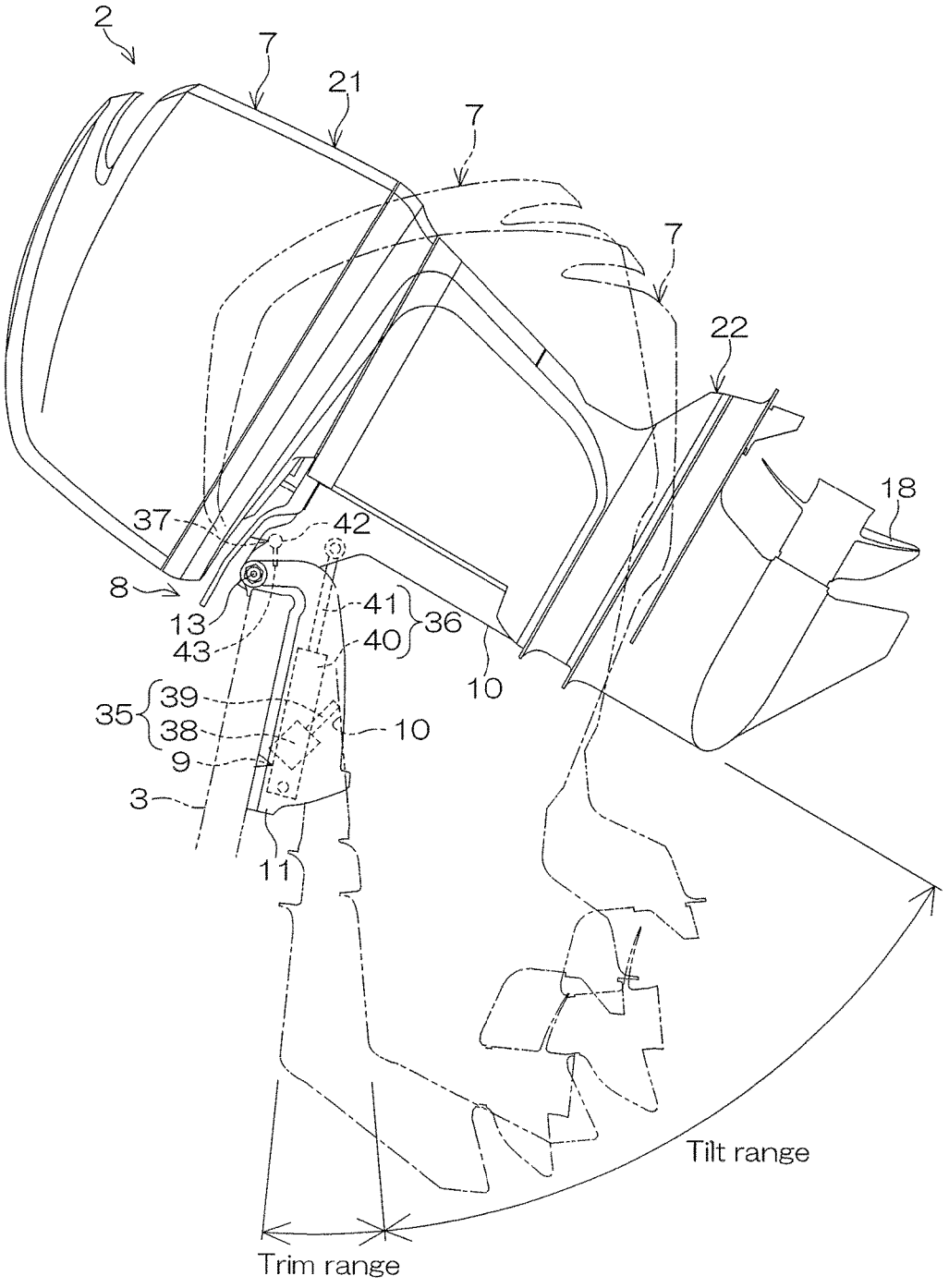
FIG. 3 is a side view showing a state in which an outboard motor main body is tilted up.
Figure 4:
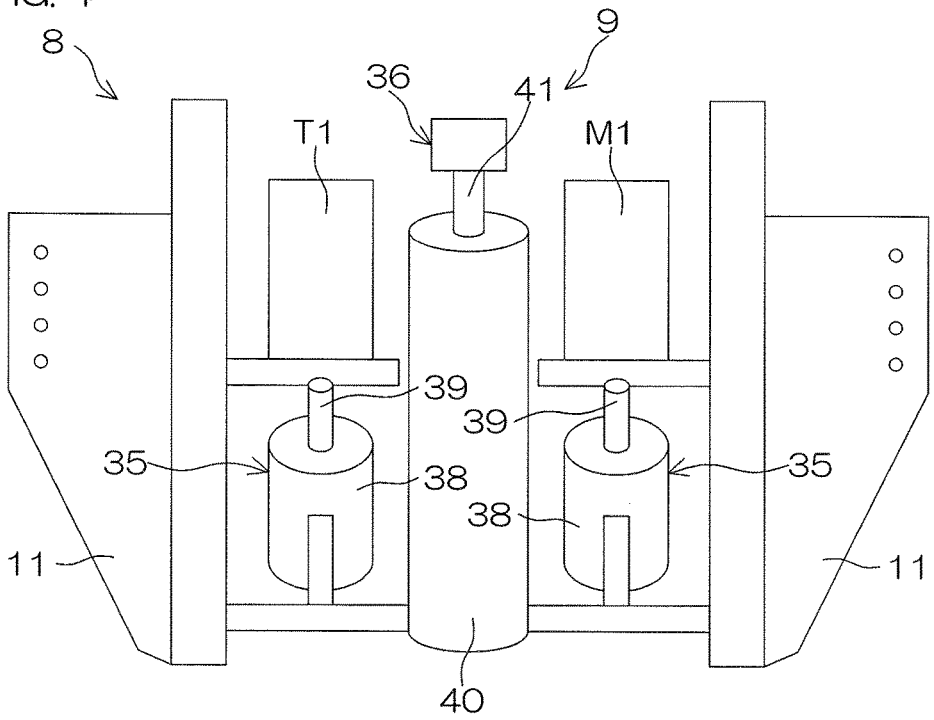
FIG. 4 is a schematic view of a mount that attaches the outboard motor main body to a vessel.

FIG. 3 is a side view showing a state in which the outboard motor main body 7 is tilted up (a state in which the inclination angle is within a tilt range). FIG. 4 is a schematic view of the mount 8, showing a portion of the mount 8 viewed from the rear side.

The outboard motor main body 7 is turned around the tilt shaft 13 so as to switch between a substantially vertical posture and a greatly inclined posture in which the front surface of the outboard motor main body 7 (front surfaces of the engine cover 21 and the casing 22) is inclined downward. In a case in which an inclination angle of the outboard motor main body 7 when a lower end of the driveshaft 16 comes closest to the hull 3 is zero, a range in which the inclination angle of the outboard motor main body 7 is small is a trim range, and a range in which the inclination angle of the outboard motor main body 7 is larger than an upper limit boundary value of the trim range is a tilt range. In FIG. 3, a state in which the inclination angle of the outboard motor main body 7 is at a lower limit boundary value of the trim range (full trim-in) is shown by an alternate long and short dashed line, and a state in which the inclination angle of the outboard motor main body 7 is at the upper limit boundary value of the trim range (full trim-out) is shown by an alternate long and two short dashed line. Moreover, in FIG. 3, a state in which the inclination angle of the outboard motor main body 7 is at an upper limit value of the tilt range (full tilt-up) is shown by a solid line. The upper limit value of the tilt range is, for example, a maximum value of the inclination angle of the outboard motor main body 7. The outboard motor main body 7 is able to be held at an arbitrary position in the trim range and the tilt range.

Turning the outboard motor main body 7 upward in the trim range is referred to as "trim-up," and turning the outboard motor main body 7 downward in the trim range is referred to as "trim-down." As a more functional definition, turning the outboard motor main body 7 upward for trim adjustment of the vessel 1 is referred to as "trim-up," and turning the outboard motor main body 7 for trim adjustment of the vessel 1 is referred to as "trim-down." On the other hand, turning the outboard motor main body 7 upward for the purpose of raising the propeller 18 above the surface of the water is referred to as "tilt-up," and turning the outboard motor main body 7 downward for the purpose of lowering the propeller 18 under the surface of the water is referred to as "tilt-down." Therefore, tilt-up and tilt-down may be used for upward and downward movements of the outboard motor main body 7 in both of the trim range and the tilt range.

As shown in FIG. 4, the PTT mechanism 9 includes, for example, two trim cylinders 35, and one tilt cylinder 36. The respective trim cylinders 35 and the tilt cylinder 36 are located between the two clamp brackets 11. Further, an inclination angle sensor 37 is located between the two clamp brackets 11. The two trim cylinders 35 overlap each other as viewed from the left-right direction of the vessel 1. The two trim cylinders 35 are located on both the left and right sides of the tilt cylinder 36. Each trim cylinder 35 is located diagonally along the front-rear direction of the vessel 1 so that an upper end of the trim cylinder 35 is positioned at the rear side relative to a lower end of the trim cylinder 35. Similarly, the tilt cylinder 36 is located diagonally along the front-rear direction of the vessel 1 so that an upper end of the tilt cylinder 36 is positioned at the rear side relative to a lower end of the tilt cylinder 36. The trim cylinders 35 and the tilt cylinder 36 are respectively, for example, hydraulic cylinders. As shown in FIG. 4, a tank T1 that stores a hydraulic oil and an electric motor M1 that drives a hydraulic pump to supply the hydraulic oil are located between the two clamp brackets 11. The outboard motor main body 7 and the swivel bracket 10 are turned around the tilt shaft 13 by the respective trim cylinders 35 and the tilt cylinder 36. The electric motor M1 and the hydraulic pump are an example of an electric actuator in a preferred embodiment of the present invention, and supply a driving force to the PTT mechanism 9.

Each trim cylinder 35 includes a main body 38 and a trim rod 39. Each main body 38 is joined to a corresponding clamp bracket 11. The trim rod 39 projects diagonally upward from an upper end portion of the main body 38 to the rear side. The trim rod 39 is reciprocated in an axial direction of the trim rod 39 by a hydraulic force inside the main body 38. As shown by the alternate long and two short dashed line in FIG. 3, in the state in which the inclination angle of the outboard motor main body 7 is within the trim range, upper end portions of the respective trim rods 39 are in contact with the swivel bracket 10. Therefore, in this state, the outboard motor main body 7 is supported by the two trim rods 39 from the front side through the swivel bracket 10. In addition, when the inclination angle of the outboard motor main body 7 increases and reaches the tilt range, the upper end portions of the respective trim rods 38 separate from the swivel bracket 10. Therefore, support of the outboard motor main body 7 by the two trim rods 39 is released.

An inclination angle of the outboard motor main body 7 when the trim rods 39 are in a maximally extended state and in contact with the swivel bracket 10 is the upper limit boundary value of the trim range. That is, the upper limit boundary value of the trim range is defined by an upper limit value of the inclination angle that is able to be changed by driving of the trim cylinders 35. On the other hand, a minimum value of the inclination angle that the outboard motor main body 7 can take when the trim rods 39 are in a minimally extended state, that is, contracted state, is the lower limit boundary value of the trim range.

The tilt cylinder 36 includes a main body 40 and a tilt rod 41. A lower end portion of the main body 40 is joined to the clamp brackets 11. The tilt rod 41 projects diagonally upward from an upper end portion of the main body 40 to the rear side. An upper end portion of the tilt rod 41 is joined to the swivel bracket 10. The tilt rod 41 is reciprocated in an axial direction of the tilt rod 41 by hydraulic pressure inside the main body 40. The upper end portion of the tilt rod 41 is joined to the swivel bracket 10 irrespective of whether the inclination angle of the outboard motor main body 7 is within the trim range or the tilt range. Therefore, the outboard motor main body 7 is supported by the tilt cylinder 36 irrespective of whether the inclination angle of the outboard motor main body 7 is within the trim range or the tilt range.

In a state in which the outboard motor main body 7 is within the trim range, the outboard motor main body 7 is supported by the two trim cylinders 35 and the one tilt cylinder 36. In this state, the outboard motor main body 7 is turned up and down around the tilt shaft 13 by the two trim cylinders 35 and the one tilt cylinder 36. The inclination angle of the outboard motor main body 7 increases with an increase in the projecting amount of the respective trim rods 39 and the tilt rod 41. When the inclination angle of the outboard motor main body 7 increases and reaches the tilt range, support of the outboard motor main body 7 by the two trim cylinders 35 is released, and the outboard motor main body 7 is supported by the one tilt cylinder 36. In this state, the outboard motor main body 7 is turned up and down around the tilt shaft 13 by the one tilt cylinder 36. The inclination angle of the outboard motor main body 7 increases with an increase in the projecting amount of the tilt rod 41. By extension and contraction of the tilt rod 41, the inclination angle of the outboard motor main body 7 is changed in a range from the lower limit boundary value of the trim range to the upper limit value of the tilt range.

The inclination angle sensor 37 includes, for example, a main body 42 and a lever 43. The main body 42 is held by the swivel bracket 10. The lever 43 projects forward from the main body 42 in a state in which the driveshaft 16 of the outboard motor main body 7 is in a substantially vertical direction. The lever 43 is turnable around a horizontal axis passing through the main body 42 with respect to the main body 42. A tip end portion of the lever 43 is joined to the clamp brackets 11. When the outboard motor main body 7 and the swivel bracket 10 are turned around the tilt shaft 13, the main body 42 turns around the tilt shaft 13 while the tip end portion of the lever 43 is joined to the clamp brackets 11. Accordingly, the lever 43 turns around the horizontal axis with respect to the main body 42, and is located at a turning angle in proportion to the inclination angle of the outboard motor main body 7.

The inclination angle sensor 37 includes, for example, a potentiometer. To this potentiometer, a voltage is applied. The inclination angle sensor 37 outputs, as an angle detection value, a voltage that, for example, linearly changes according to the inclination angle of the outboard motor 7 to the ECU 20. For example, an angle detection value (voltage) to be input to the ECU 20 from the inclination angle sensor 37 increases with an increase in the inclination angle of the outboard motor main body 7. Accordingly, an angle detection value corresponding to the inclination angle of the outboard motor main body 7 is input to the ECU 20. When the inclination angle sensor 37 fails (for example, short-circuits or disconnects), an angle detection value (abnormality detection value) smaller or larger than a value that is input when the inclination angle sensor 37 is normal is input to the ECU 20.

More specifically, an angle detection value (voltage) to be input to the ECU 20 when the inclination angle sensor 37 is normal is, for example, larger than 0 V and smaller than 5 V (drive voltage). However, when disconnection occurs in the inclination angle sensor 37, 0 V is input in the case of pull-down, and for example, 5 V is input in the case of pull-up, to the ECU 20. Pull-down means connection to a ground wire (ground) side in the case of disconnection. Pull-up means connection to the power wire side in the case of disconnection. When the inclination angle sensor 37 short-circuits, a voltage corresponding to the opposite side of the short-circuit is input to the ECU 20. That is, to the ECU 20, 0 V is input when the inclination angle sensor short-circuits to the ground, and 5 V is input when the inclination angle sensor short-circuits to a wire to which a voltage of 5 V is applied, and for example, 12 V (power supply voltage) is input when the inclination angle sensor short-circuits to the power supply. Therefore, when the inclination angle sensor 37 fails, an angle detection value smaller or larger than a value that is input when the inclination angle sensor 37 is normal is input to the ECU 20. Accordingly, the ECU 20 is able to detect a failure (disconnection and short-circuit) of the inclination angle sensor 37 based on an angle detection value input from the inclination angle sensor 37.

Figure 5:
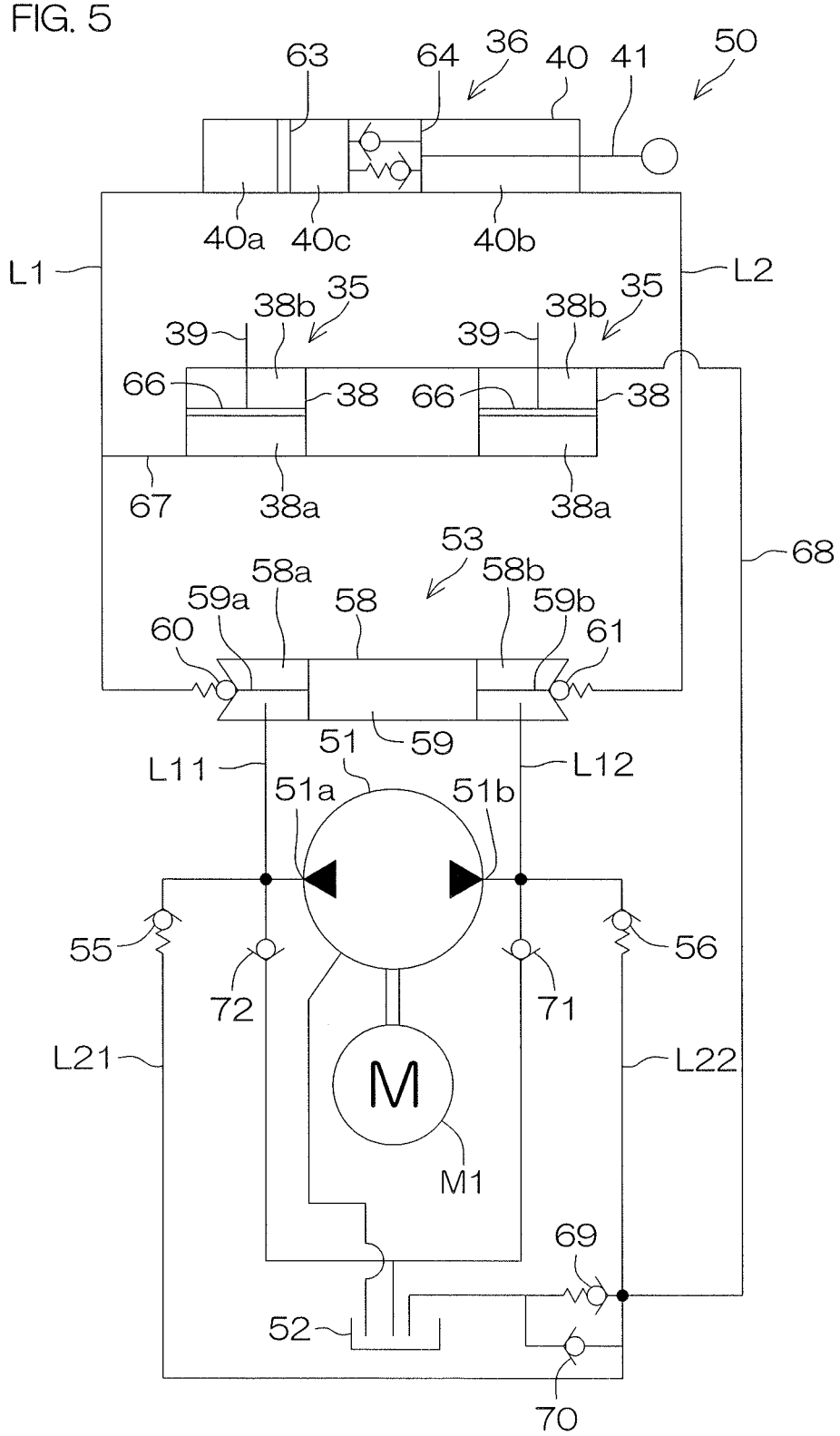
FIG. 5 shows an example of a hydraulic circuit relating to trim cylinders and a tilt cylinder.

FIG. 5 shows an example of a hydraulic circuit 50 relating to the trim cylinders 35 and the tilt cylinder 36. The PTT mechanism 9 includes the hydraulic circuit 50. The hydraulic circuit 50 is actuated by a hydraulic pump 51, and includes a reserve tank 52, a main valve unit 53, the pair of trim cylinders 35, the tilt cylinder 36, an up relief valve 55, and a down relief valve 56, etc.

The hydraulic pump 51 is driven by the electric motor M1. The electric motor M1 is able to rotate forward and in reverse, and the hydraulic pump 51 is accordingly driven forward or in reverse by the electric motor M1. The main valve unit 53 is connected to two ports 51*a* and 51*b* of the hydraulic pump 51.

The main valve unit 53 includes a cylinder 58, a shuttle 59 that slides inside the cylinder 58, and two on-off valves 60 and 61 respectively located on both sides of the cylinder 58, and two oil chambers 58 and 58*b* on both sides of the shuttle 59. The two ports 51*a* and 51*b* of the hydraulic pump 51 are coupled through oil passages L11 and L12 to the two oil chambers 58*a* and 58*b*, respectively. Each of the on-off valves 60 and 61 is opened when a hydraulic pressure inside a corresponding oil chamber 58*a* or 58*b* increases. In addition, each of the on-off valves 60 and 61 is opened by being pushed by a corresponding needle 59*a* or 59*b* coupled to the shuttle 59.

The tilt cylinder 36 includes the main body 40, a free piston 63 that slides inside the main body 40, a piston 64 that also slides inside the main body 40, and the tilt rod 41 coupled to the piston 64. Inside the main body 40, three oil chambers 40*a*, 40*b*, and 40*c* are comparted by the free piston 63 and the piston 64. The oil chamber 40*a* is coupled to one on-off valve 60 of the main valve unit 53 through the oil passage L1, and the oil chamber 40*b* is coupled to the other on-off valve 61 of the main valve unit 53 through the oil passage L2.

Each trim cylinder 35 includes the main body 38, a piston 66, and the trim rod 39 coupled to the piston 66, and inside the main body 38, two oil chambers 38*a* and 38*b* are comparted on both sides of the piston 66. To the lower oil chamber 38*a* of each trim cylinder 35, a branched oil passage 67 is coupled. The branched oil passage 67 branches from the oil passage L1. To the upper oil chamber 38*b* of each trim cylinder 35, a returning oil passage 68 is connected. The returning oil passage 68 is connected to the reserve tank 52 through a corresponding one of unidirectional valves 69 and 70 provided in parallel and in opposite directions to each other.

From the oil passages L11 and L12 connected to two ports 51*a* and 51*b* of the hydraulic pump 51, bypass oil passages L21 and L22 are branched, respectively. In these bypass oil passages L21 and L22, the up relief valve 55 and the down relief valve 56 are respectively interposed. The returning oil passage 68 is connected to the bypass oil passage L22 as well, and in two oil passages provided in parallel between the bypass oil passage L22 and the reserve tank 52, the unidirectional valves 69 and 70 are respectively interposed.

When the hydraulic pump 51 is driven forward by the electric motor M1, the hydraulic pump 51 sucks in the hydraulic oil from the port 51*b* and discharges the hydraulic oil from the port 51*a*. The discharged hydraulic oil is supplied from the main valve unit 53 to the oil passage L1. Accordingly, the hydraulic oil is supplied to the lower oil chamber 40*a* of the tilt cylinder 36, and the hydraulic oil is supplied to the lower oil chambers 38*a* of the trim cylinders 35. Accordingly, the tilt rod 41 and the trim rods 39 are respectively extended to turn the swivel bracket 10 upward. When the hydraulic oil is low, the hydraulic oil is replenished from the reserve tank 52 through the unidirectional valve 71. On the other hand, the hydraulic oil in the upper oil chamber 40*b* of the tilt cylinder 36 is drawn into the hydraulic pump 51 through the oil passage L2 and the main valve unit 53. At this time, the on-off valve 61 of the main valve unit 53 is opened by being pushed by the needle 59*b* of the shuttle 59.

When the hydraulic pump 51 is driven in reverse by the electric motor M1, the hydraulic pump 51 sucks in the hydraulic oil from the port 51*a* and discharges the hydraulic oil from the port 51*b*. The discharged hydraulic oil is supplied from the main valve unit 53 to the oil passage L2. Accordingly, the hydraulic oil is supplied to the upper oil chamber 40*b* of the tilt cylinder 36. The tilt rod 41 is thus contracted to turn the swivel bracket 10 downward. When the hydraulic oil is low, the hydraulic oil is replenished from the reserve tank 52 through the unidirectional valve 72. On the other hand, the hydraulic oil in the lower oil chamber 40*a* of the tilt cylinder 36 and the lower oil chambers 38*a* of the trim cylinders 35 is drawn into the hydraulic pump 51 through the oil passage L1, the branched oil passage 67, and the main valve unit 53. The tilt rod 41 contracts by being pushed by the swivel bracket 10.

Each of the up relief valve 55 and the down relief valve 56 operates to open when the pressure inside the corresponding oil passage L11 or L12 reaches a predetermined pressure or more so as to return the hydraulic oil into the reserve tank 52 through the bypass oil passage L21 or L22.

At the time of a tilt-up/tilt-down operation, when the trim rods 39 extend to their maximum lengths, the following tilt-up is performed exclusively by the tilt cylinder 36. In this state, when a high load is applied to the swivel bracket 10, that is, the tilt rod 41, the pressure inside the oil passage L11 reaches the predetermined pressure and the up relief valve 55 opens, and the hydraulic oil flows into the bypass oil passage L21. More specifically, at the time of traveling of the vessel 1, the outboard motor 2 generates a propulsive force, and therefore, the outboard motor main body 7 is subjected to a reaction force by the surrounding water, and accordingly, a high downward load is applied to the swivel bracket 10. In this case, when the upper limit of the trim range is reached by a vessel operator performing a tilt-up/trim-up operation and the tilt-up/trim-up operation is continued, the up relief valve 55 opens. Accordingly, the inclination angle of the outboard motor main body 7 is held near the upper limit boundary value of the trim range.

At the time of a tilt-down/trim-down operation, when the trim rods 39 and the tilt rod 41 contract to their shortest lengths, contractions of the trim rods 39 and the tilt rod 41 are mechanically restricted. When the tilt-down/trim-down operation still continues and the hydraulic pump 51 continuously operates, the pressure inside the oil passage L12 reaches the predetermined pressure, the down relief valve 56 opens, and the hydraulic oil flows into the bypass oil passage L22. At this time, the inclination angle of the outboard motor main body 7 is held near the lower limit boundary value of the trim range.

Figure 6:
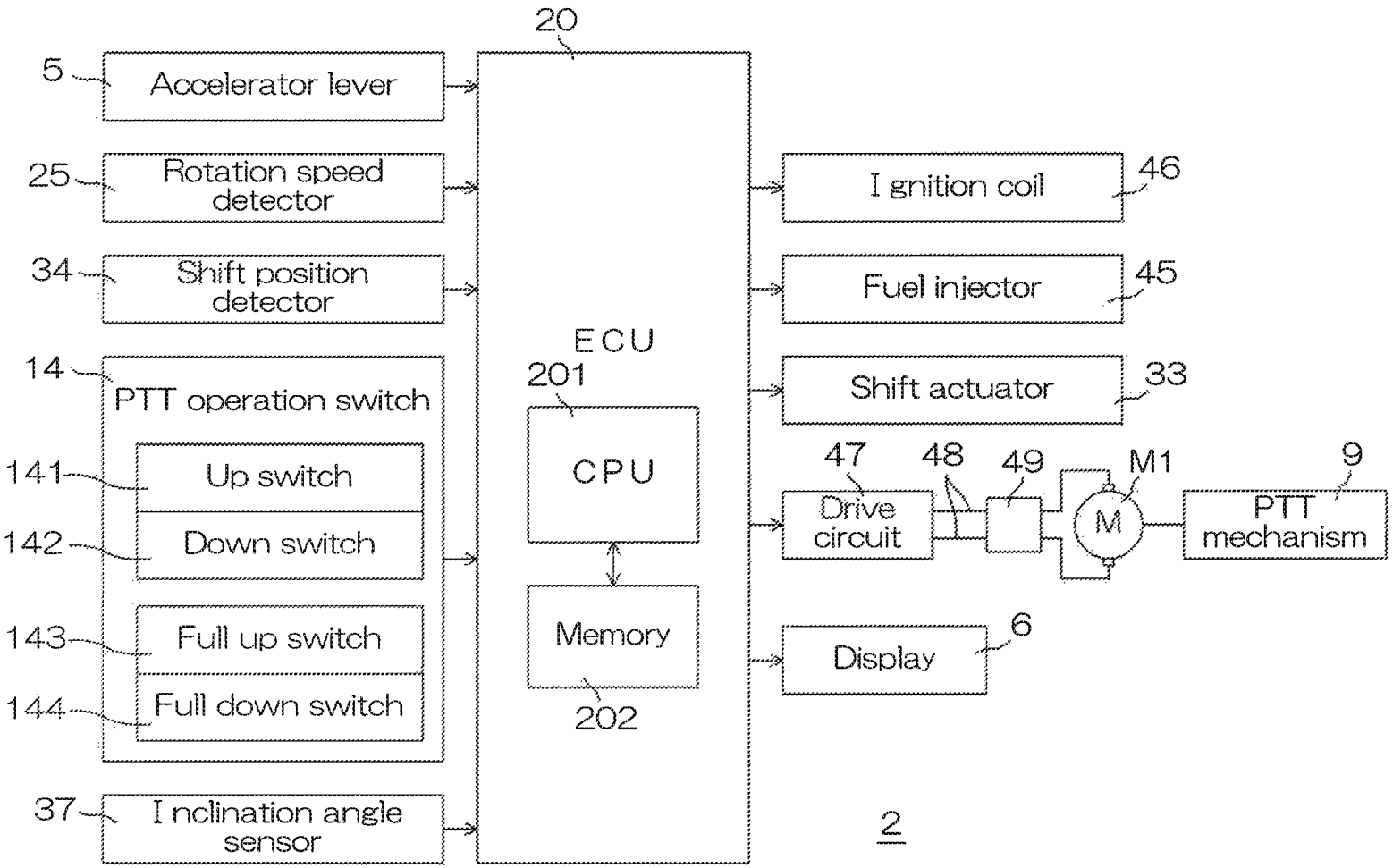
FIG. 6 is a block diagram showing an electrical configuration of the outboard motor.

FIG. 6 is a block diagram showing an electrical configuration of the outboard motor 2. To the ECU 20, a rotation signal from the rotation speed detector 25, a shift position signal from the shift position detector 34, and an angle signal from the inclination angle sensor 37 are input. In addition, to the ECU 20, an accelerator/shift command signal corresponding to an operation of the accelerator lever 5 is input. Further, to the ECU 20, a trim/tilt command signal from the PTT operation switch 14 is input. The PTT operation switch 14 includes an up switch 142 to be operated by an operator to command trim-up/tilt-up, and a down switch 141 to be operated by an operator to command trim-down/tilt-down. Further, the PTT operation switch 14 includes a full up switch 143 to be operated by an operator mainly for the purpose of raising the outboard motor main body 7 to a highest position in the tilt range. Further, the PTT operation switch 14 includes a full down switch 144 to be operated by an operator mainly for the purpose of lowering the outboard motor main body 7 to a lowest position in the trim range.

The ECU 20 displays information on the inclination angle detected by the inclination angle sensor 37 on the display 6. The operator is able to operate the PTT operation switch 14 while referring to this display.

The ECU 20 controls electric components equipped in the outboard motor 2. More specifically, the ECU 20 controls the electric motor M1 and the shift actuator 33. Further, the ECU 20 controls a fuel injector 45 equipped in the engine 15 to control energization of the ignition coils 26. The ECU 20 includes a processor 201 and a memory 202. In the memory 202, a program to be executed by the processor 201 is stored. By executing the program stored in the memory 202 by the processor 201, the ECU 20 performs tilt/trim control as described below. The tilt/trim control inclines the outboard motor main body 7 in the trim range and the tilt range by controlling energization of the electric motor M1 by the ECU 20.

The ECU 20 supplies a forward drive current or a reverse drive current to the electric motor M1 by controlling the drive circuit 47. The forward drive current drives the electric motor M1 in a forward rotating direction. The reverse drive current drives the outboard motor M1 in a reverse rotating direction. The forward rotating direction is, in the present preferred embodiment, a rotating direction to trim-up/tilt-up the outboard motor main body 7. The reverse rotating direction is, in the present preferred embodiment, a rotating direction to trim-down/tilt-down the outboard motor main body 7. The drive circuit 47 supplies a current to the electric motor M1 through a power supply line 48 defining a power supply path. In the power supply line 48, a thermal breaker 49 is interposed. When a large current continuously flows in the power supply line 48 for a long period of time, the thermal breaker 49 opens the circuit to shut-off the power supply path. Accordingly, the electric motor M1 is protected from overcurrent.

The thermal breaker 49 includes a thermosensitive body (typically, a bimetal member) that is raised in temperature and deformed by a large current continuously flowing in the power supply line 48, and a contact that shuts off the power supply path in response to the deformation of the thermosensitive body. When the thermal breaker 49 is once actuated, the power supply path cannot be recovered until the thermosensitive body has cooled down.

The drive circuit 47 may include an inverter circuit that supplies a forward drive current or a reverse drive current to the electric motor M1. In addition, the drive circuit 47 may include a forward rotation relay that defines a circuit to supply a forward drive current to the electric motor M1, and a reverse rotation relay that defines a circuit to supply a reverse drive current to the electric motor M1.

The ECU 20 is configured or programmed to perform up energization control to supply a forward drive current to the electric motor M1 so that the inclination angle of the outboard motor main body 7 increases while the up switch 141 is operated. In addition, the ECU 20 is configured or programmed to perform down energization control to supply a reverse drive current to the electric motor M1 so that the inclination angle of the outboard motor main body 7 decreases while the down switch 142 is operated.

Further, the ECU 20 is configured or programmed to, when the full up switch 143 is operated, start up energization control to supply a forward drive current to the electric motor M1 so that the inclination angle of the outboard motor main body 7 increases, and continue the up energization control even after the operation ends. Further, the ECU 20 is configured or programmed to, when the full down switch 144 is operated, start down energization control to supply a reverse drive current to the electric motor M1 so that the inclination angle of the outboard motor main body 7 decreases, and continue the down energization control even after the operation ends. Continuing the up energization control and the down energization control started by operations of the full up switch 143 and the full down switch 144 are canceled by an operation of the up switch 141 or the down switch 142 (refer to Steps S2 and S8 in FIG. 8).

Figure 7:
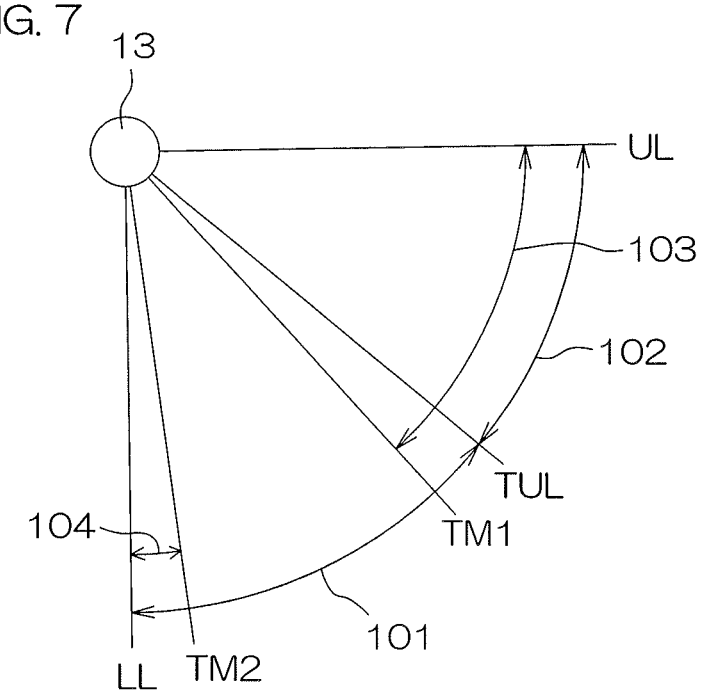
FIG. 7 is a view showing a trim range, a tilt range, an up trim limiting region, and a down trim limiting region.

FIG. 7 is a view showing a trim range 101, a tilt range 102, an up trim limiting region 103, and a down trim limiting region 104. The trim range 101 is defined between a lower limit value (lower limit boundary value) LL that is an inclination angle when the outboard motor main body 7 is maximally lowered, and an upper limit boundary value TUL that is an inclination angle at a highest position of the outboard motor main body 7 when the outboard motor main body is raised by the trim cylinders 35. An inclination angle region exceeding the trim range 101 is the tilt range 102, and an upper limit value UL of the tilt range is an inclination angle at a highest position of the outboard motor main body 7 when the outboard motor main body is raised by the tilt cylinder 36. For convenience of description, in FIG. 7, the trim range 101 is shown larger than that in the example shown in FIG. 3.

The up trim limiting region 103 is set so as to include the upper limit boundary value TUL of the trim range 101 and include a predetermined inclination angle range not more than the upper limit boundary value TUL and the entire tilt range 102. That is, the up trim limiting region 103 is set to, in the present preferred embodiment, a range from a first intermediate value TM1 to the upper limit value UL in the tilt range 102. In addition, the down trim limiting region 104 is set to a predetermined inclination angle range that includes the lower limit boundary value LL of the trim range 101 and not less than the lower limit boundary value LL. That is, the down trim limiting region 104 is set to, in the present preferred embodiment, a range from a second intermediate value TM2 (<TM1) to the lower limit boundary value LL in the trim range 101.

The up trim limiting region 103 is an inclination angle range in which the up energization control to drive the electric motor M1 to rotate forward is able to be limited when the outboard motor main body 7 is trimmed-up/tilted-up. The down trim limiting region 104 is an inclination angle range in which the down energization control to drive the electric motor M1 to rotate in reverse is able to be limited when the outboard motor main body 7 is trimmed-down/tilted-down. Limiting the up energization control includes limiting the supply of a forward drive current to the electric motor M1, and in the present preferred embodiment, includes stopping the supply of a forward drive current to the electric motor M1. Limiting the down energization control includes limiting the supply of a reverse drive current to the electric motor M1, and in the present preferred embodiment, includes stopping the supply of a reverse drive current to the electric motor M1.

Figure 8:
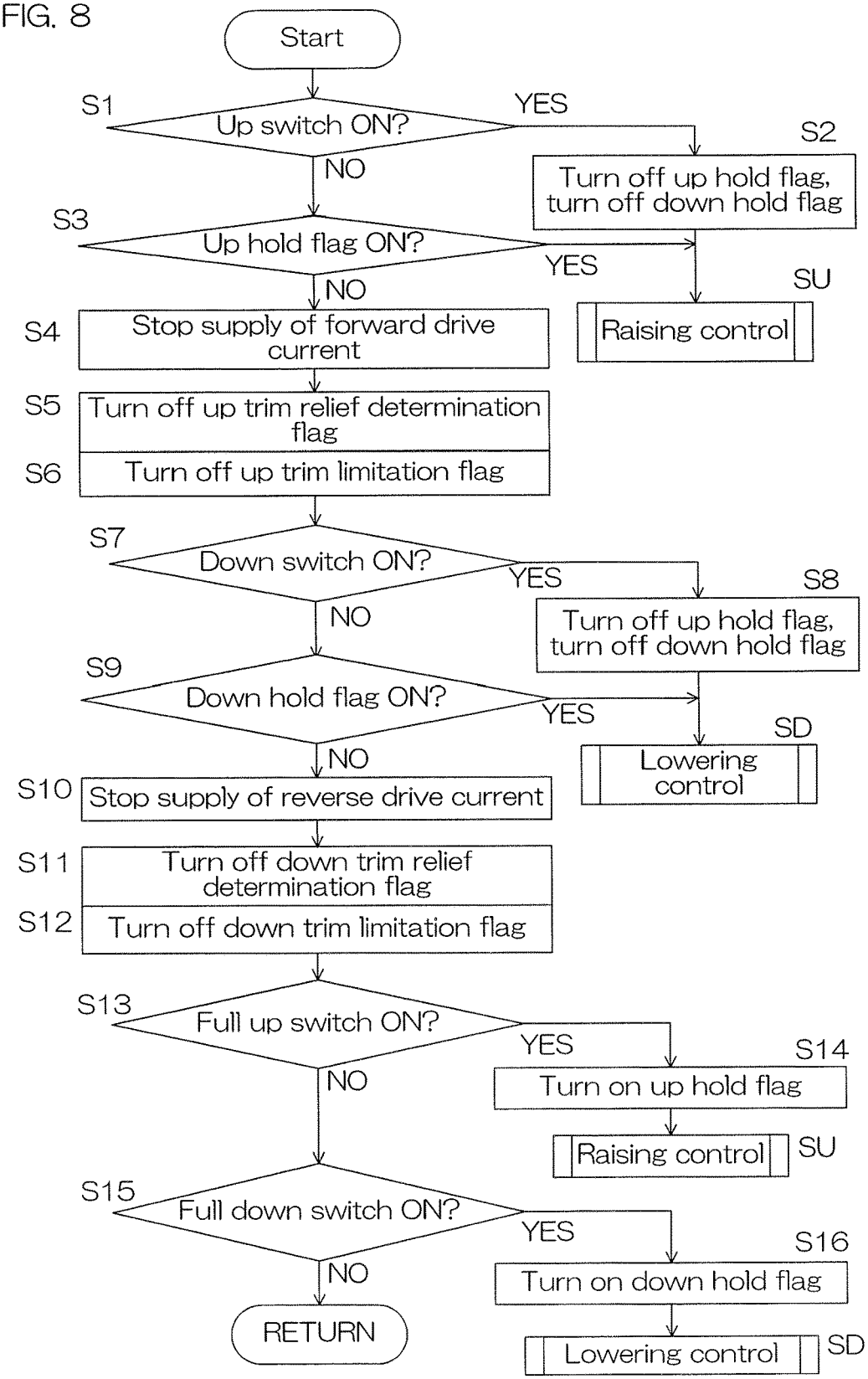
FIG. 8 is a flowchart showing an example of a control operation to be performed by an ECU equipped in the outboard motor, mainly showing a branch processing example corresponding to an operation of a PTT operation switch.
Figure 9:
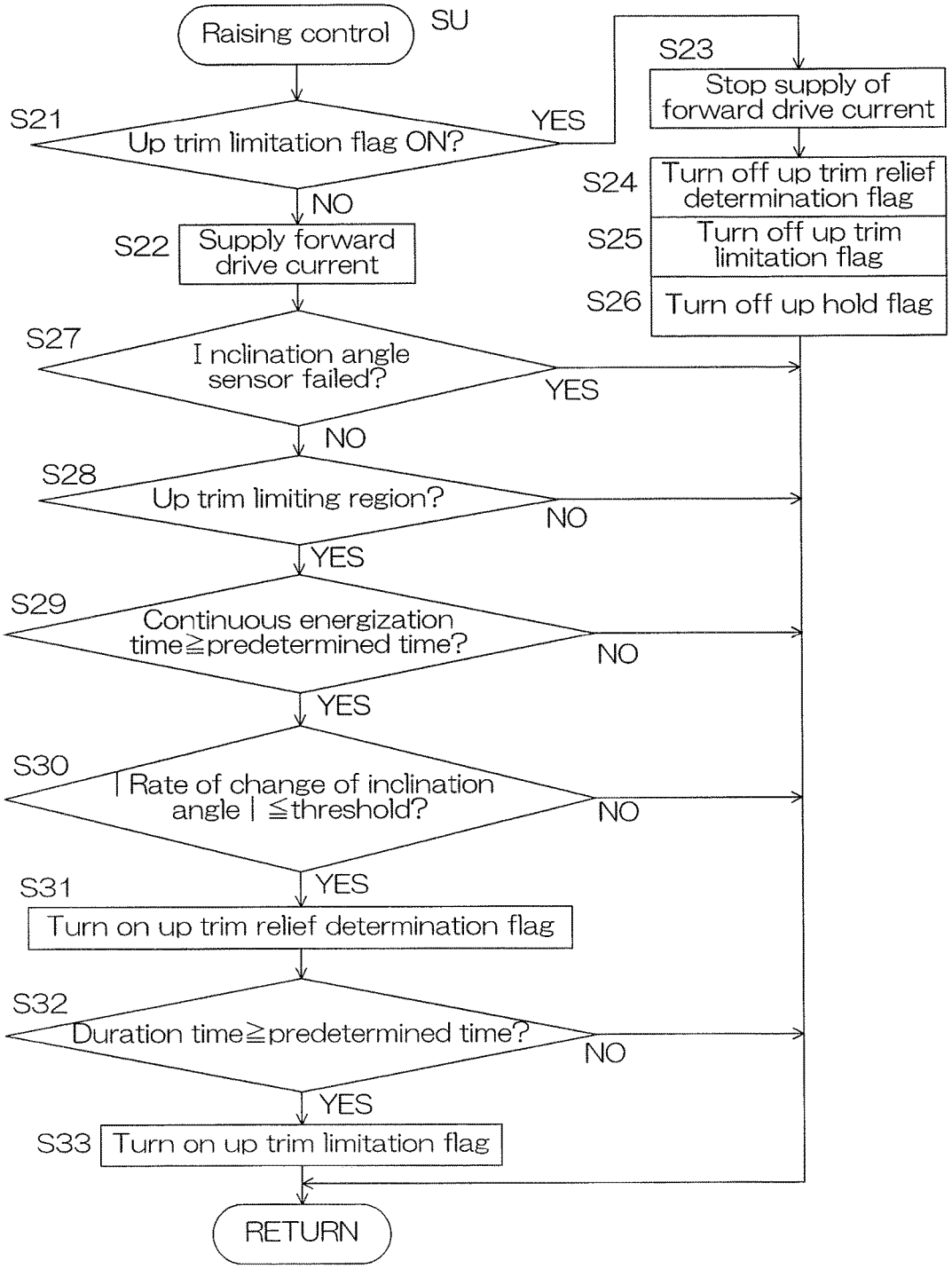
FIG. 9 is a flowchart showing an example of a control operation to be performed by the ECU, showing an example of a raising control to raise the outboard motor main body.
Figure 10:
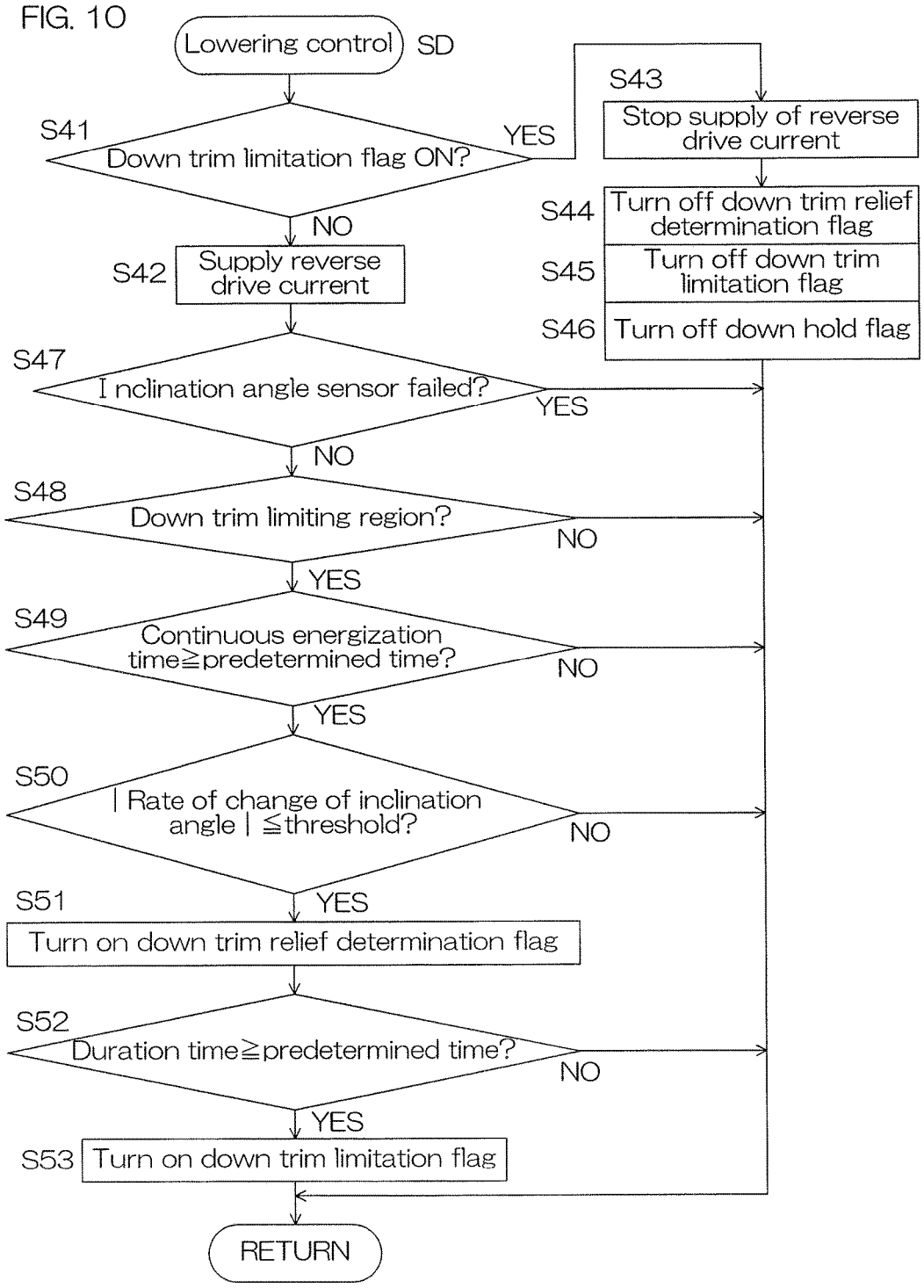
FIG. 10 is a flowchart showing an example of a control operation to be performed by the ECU, showing an example of a lowering control to lower the outboard motor main body.

FIG. 8, FIG. 9, and FIG. 10 are flowcharts showing examples of control operations to be performed by the ECU 20, showing examples of tilt/trim control to be repeated by the ECU 20 within a predetermined control period. FIG. 8 shows an example of branch processing corresponding to an operation of the PTT operation switch 14. FIG. 9 shows a control example relating to raising (trim-up/tilt-up) of the outboard motor main body 7, and FIG. 10 shows a control example relating to lowering (trim-down/tilt-down) of the outboard motor main body 7.

As shown in FIG. 8, the ECU 20 judges whether the up switch 141 has been turned on (Step S1). When the up switch 141 is on (Step S1: YES), the ECU 20 turns off an up hold flag and a down hold flag (Step S2), and shifts to the raising control SU shown in FIG. 9. The up hold flag is turned on when the full up switch 143 is operated (Step S13, S14). The down hold flag is turned on when the full down switch 144 is operated (Step S15, S16).

When the up switch 141 is off (Step S1: NO), the ECU 20 judges whether the up hold flag is on (Step S3). When the up hold flag is on (Step S3: YES), the process of the ECU 20 shifts to the raising control SU shown in FIG. 9. When the up hold flag is off (Step S3: NO), the ECU 20 stops application of a forward drive current to the electric motor M1 (Step S4). That is, when a forward drive current is being applied, this application is stopped, and when a forward drive current is not being applied, the non-energizing state is maintained.

The ECU 20 further turns off an up trim relief determination flag and an up trim limitation flag (Steps S5 and S6). The up trim relief determination flag is turned on when a continuous energization time of the electric motor M1 is equal to or longer than a predetermined time (for example, about 1 second), and a magnitude of a rate of change of the inclination angle is equal to or less than a predetermined determination threshold (refer to Step S28 in FIG. 9). The up trim limitation flag is turned on when an on state of the up trim relief determination flag continues for a predetermined duration of time or longer, and shows that energization of the electric motor M1 should be limited (in the present preferred embodiment, stopped) (refer to Step S30 in FIG. 9).

Further, the ECU 20 judges whether the down switch 142 is on (Step S7). When the down switch 142 is on (Step S7: YES), the ECU 20 turns off the up hold flag and the down hold flag (Step S8), and shifts to the lowering control SD shown in FIG. 10. When the down switch 142 is off (Step S7: NO), the ECU 20 judges whether the down hold flag is on (Step S9). When the down hold flag is on (Step S9: YES), the process of the ECU 20 shifts to the lowering control SD shown in FIG. 10. When the down hold flag is off (step S9: NO), the ECU 20 stops application of a reverse drive current to the electric motor M1 (Step S10). That is, when a reverse drive current is being applied, this supply is stopped, and when a reverse drive current is not being applied, the non-energizing state is maintained. The ECU 20 further turns off a down trim relief determination flag and a down trim limitation flag (Steps S11 and S12). The down trim relief determination flag is turned on when a continuous energization time of the electric motor M1 is equal to or longer than a predetermined time (for example, about 1 second), and a magnitude of a rate of change of the inclination angle is equal to or less than a predetermined determination threshold (refer to Step S38 in FIG. 10). The down trim limitation flag is turned on when an on state of the down trim relief determination flag continues for a predetermined duration of time or longer, and shows that energization of the electric motor M1 should be limited (in the present preferred embodiment, stopped) (refer to Step S41 in FIG. 10).

The ECU 20 further judges whether the full up switch 143 has been operated (Step S13). When the full up switch 143 is operated, the ECU 20 turns on the up hold flag (Step S14), and shifts to the raising control SU shown in FIG. 9. Also, the ECU 20 judges whether the full down switch 144 has been operated (Step S15). When the full down switch 144 is operated, the ECU 20 turns on the down hold flag (Step S16), and shifts to the lowering control SD shown in FIG. 10.

When both of the up hold flag and the down hold flag are off, and any of the switches 141 to 144 of the PTT operation switch 14 has not been operated (Step S15: NO), the ECU 20 ends the process of the current control period.

In the raising control SU shown in FIG. 9, the ECU 20 judges whether the up trim limitation flag is on (Step S21). The up trim limitation flag is set to be on when forward rotation driving of the electric motor M1 should be limited, and is off in an initial state. When the up trim limitation flag is off (Step S21: NO), the ECU 20 controls the drive circuit 47 to supply a forward drive current to the electric motor M1 (Step S22: up energization control). Accordingly, the electric motor M1 is driven to rotate forward so that the tilt cylinder 36 extends the tilt rod 41 and the trim cylinders 35 extend the trim rods 39.

The ECU 20 judges whether a failure relating to the inclination angle sensor 37 has occurred (Step S27). A failure discussed above includes a disconnection failure or a short-circuit failure. When a failure has occurred (Step S27: YES), the subsequent process is skipped, and the process of the current control period is ended.

When no failure has occurred (Step S27: NO), the ECU 20 monitors an output signal of the inclination angle sensor 37, and judges whether the inclination angle of the outboard motor main body 7 is at a value within the up trim limiting region 103 (refer to FIG. 7) (Step S28). When the inclination angle is at a value out of the up trim limiting region 103 (Step S28: NO), the process of the current control period is ended. When the inclination angle is at a value within the up trim limiting region 103 (Step S28: YES), the ECU 20 further judges whether a continuous energization time from the start of application of a forward drive current is equal to or longer than a predetermined time (for example, about 1 second) (Step S29). When the result of this judgment is negative, the process of the current control period is ended. When a continuous energization time from the start of application of a forward drive current is equal to or longer than a predetermined time (Step S29: YES), the ECU 20 obtains a rate of change of the inclination angle detected by the inclination angle sensor 37, and judges whether a magnitude of the rate of change of the inclination angle is equal to or less than a predetermined determination threshold (Step S30). The rate of change of the inclination angle may be, for example, a difference in the output of the inclination angle sensor 37 between sampling periods (for example, about 250 milliseconds). When a magnitude of the rate of change of the inclination angle is larger than the predetermined determination threshold (Step S30: NO), the process of the current control period is ended. On the other hand, when a magnitude of the rate of change of the inclination angle is equal to or less than the predetermined determination threshold (Step S30: YES), this means that the inclination angle no longer increases although the electric motor M1 is driven to rotate forward. In this case, the ECU 20 turns on the up trim relief determination flag (Step S31). Then, the ECU 20 judges whether an on state of the up trim relief determination flag, that is, a state in which the inclination angle does not substantially increase although the electric motor M1 is driven to rotate forward, continues for a predetermined duration of time (for example, about 1 second) (Step S32). When the result of this determination is negative, the process of the current control period is ended. When an on state of the up trim relief determination flag continues for the predetermined duration of time (Step S32: YES), the ECU 20 turns on the up trim limitation flag (Step S33).

When the up trim limitation flag moves into an on state, even if an operator continuously operates the up switch 141, the result of judgment in Step S21 becomes affirmative, and the ECU 20 does not apply a forward drive current to the electric motor M1 (Step S23). Similarly, also when the up hold flag is on, the result of judgment in Step S21 becomes affirmative, and the ECU 20 does not supply a forward drive current to the electric motor M1. When the ECU 20 stops application of a forward drive current (Step S23), the ECU 20 turns off the up trim relief determination flag and the up trim limitation flag (Steps S24 and S25), and when the up hold flag is on, the ECU 20 turns off this flag as well (Step S26).

During traveling of the vessel 1, due to a propulsive force generated by the outboard motor main body 7, the outboard motor main body 7 is subjected to a reaction force from the water, and subjected to a high load in a lowering direction. The two trim cylinders 35 that are comparatively large in diameter and installed in parallel are able to raise (trim-up) the outboard motor main body 7 against such a high load. On the other hand, the tilt cylinder 36 that is comparatively small in diameter and only one of which is provided is not able to raise (tilt-up) the outboard motor main body 8 by itself against such a high load. Therefore, when the inclination angle of the outboard motor main body 7 reaches the upper limit boundary value TUL of the trim range 101 or a value near the upper limit boundary value, the up relief valve 55 (refer to FIG. 5) opens, and the supply of the hydraulic oil to the tilt cylinder 36 is stopped. Accordingly, the rate of change of the inclination angle detected by the inclination angle sensor 37 becomes small, and the up trim determination flag is turned on (Step S31). In this state, when the operation of the up switch 141 is continued (Step S1: YES) or the up hold flag is on (Step S3: YES), the up trim limitation flag is turned on (Step S33), and the supply of a forward drive current is stopped (Step S23: limitation of up energization control). Accordingly, the energization of the electric motor M1 is stopped, so that the electric motor M1 is prevented from being overheated. In addition, energization of the electric motor M1 is stopped before the thermal breaker 49 (refer to FIG. 6) is actuated, so that the electric motor M1 is able to be energized again without waiting for restoration of the thermal breaker 49.

When the vessel 1 is not traveling, the reaction force to be applied to the outboard motor main body 7 from the surrounding water is small, so that even when the upper limit boundary value TUL of the trim range 101 is reached, the up relief valve 55 does not open. Therefore, the outboard motor main body 7 is able to be raised within the tilt range 102. When the outboard motor main body 7 rises and its inclination angle reaches the upper limit value UL, extension of the tilt rod 41 is mechanically restricted. Accordingly, the up relief valve 55 opens. In addition, the magnitude of the rate of change of the inclination angle becomes small, so that as in the case described above, application of a forward drive current to the electric motor M1 stops. In this way, when full tilt-up of the outboard motor main body 7 is completed, energization of the electric motor M1 is stopped without actuating the thermal breaker 49.

In the lowering control SD shown in FIG. 10, the ECU 20 judges whether the down trim limitation flag is on (Step S41). The down trim limitation flag is set to be on when reverse driving of the electric motor M1 should be limited, and is off in an initial state. When the down trim limitation flag is off (Step S41: NO), the ECU 20 controls the drive circuit 47 and supplies a reverse drive current to the electric motor M1 (Step S42: down energization control). Accordingly, the electric motor M1 is driven to rotate in reverse so that the tilt cylinder 36 contracts the tilt rod 41. In the trim range 101, the trim rods 39 contract by being pushed by the swivel bracket 10.

The ECU 20 judges whether a failure relating to the inclination angle sensor 37 has occurred (Step S47). A failure discussed above includes a disconnection failure or a short-circuit failure. When a failure has occurred (Step S47: YES), the subsequent process is skipped, and the process of the current control period is ended.

When no failure has occurred (Step S47: NO), the ECU 20 monitors an output signal of the inclination angle sensor 37, and judges whether the inclination angle of the outboard motor main body 7 is at a value within the down trim limiting region 104 (refer to FIG. 7) (Step S48). When the inclination angle is at a value out of the down trim limiting region 104 (Step S48: NO), the process of the current control period is ended. When the inclination angle is at a value within the down trim limiting region 104 (Step S48: YES), the ECU 20 further judges whether a continuous energization time from the start of application of a reverse drive current is equal to or longer than a predetermined time (for example, about 1 second) (Step S49). When the result of this judgment is negative, the process of the current control period is ended. When the continuous energization time from the start of application of a reverse drive current is equal to or longer than the predetermined time (Step S49: YES), the ECU 20 obtains a rate of change of the inclination angle detected by the inclination angle sensor 37, and judges whether a magnitude of the rate of change of the inclination angle is equal to or less than a predetermined determination threshold (Step S50). The rate of change of the inclination angle may be, for example, a difference in the output of the inclination angle sensor 37 between sampling periods. When the magnitude of the rate of change of the inclination angle is larger than the predetermined determination threshold (Step S50: NO), the process of the current control period is ended. On the other hand, when the magnitude of the rate of change of the inclination angle is equal to or less than the predetermined determination threshold (Step S50: YES), this means that the inclination angle no longer decreases although the electric motor M1 is driven to rotate in reverse. In this case, the ECU 20 turns on the down trim relief determination flag (Step S51). Then, the ECU 20 judges whether an on state of the down trim relief determination flag, that is, a state in which the inclination angle does not substantially decrease although the electric motor M1 is driven to rotate in reverse, continues for a predetermined duration of time (for example, about 1 second) (Step S52). When the result of this judgment is negative, the process of the current control period is ended. When an on state of the down trim relief determination flag continues for the predetermined duration of time (Step S52: YES), the ECU 20 turns on the down trim limitation flag (Step S53).

When the down trim limitation flag moves into an on state, even if the operator continuously operates the down switch 142, the result of judgment in Step S41 becomes affirmative, and the ECU 20 does not apply a reverse drive current to the electric motor M1 (Step S43: limitation of down energization control). Similarly, also when the down hold flag is on, the result of judgment in Step S41 becomes affirmative, and the ECU 20 does not supply a reverse drive current to the electric motor M1. When the ECU 20 stops application of the reverse drive current (Step S43), the ECU turns off the down trim relief determination flag and the down trim limitation flag (Steps S44 and S45), and when the down hold flag is on, the ECU turns off this flag as well (Step S46).

When the inclination angle of the outboard motor main body 7 reaches the lower limit boundary value LL of the trim range 101, contractions of the trim rods 39 and the tilt rod 41 are mechanically restricted. Then, the pressure in the oil passage L12 increases and the down relief valve 56 (refer to FIG. 5) opens. In addition, the rate of change of the inclination angle detected by the inclination angle sensor 37 becomes small, and the down trim determination flag is turned on (Step S51). In this state, when the operation of the down switch 142 is continued (Step S7: YES), or the down hold flag is on (Step S9: YES), the down trim limitation flag is turned on (Step S53), and the supply of the reverse drive current is stopped (Step S43). In this way, when full tilt-down (full trim-down) of the outboard motor main body 7 is completed, energization of the electric motor M1 is stopped, and accordingly, the electric motor M1 is prevented from being overheated. In addition, energization of the electric motor M1 is stopped before the thermal breaker 49 (refer to FIG. 6) is actuated, so that the electric motor M1 is able to be energized again without waiting for restoration of the thermal breaker 49.

Figure 11:
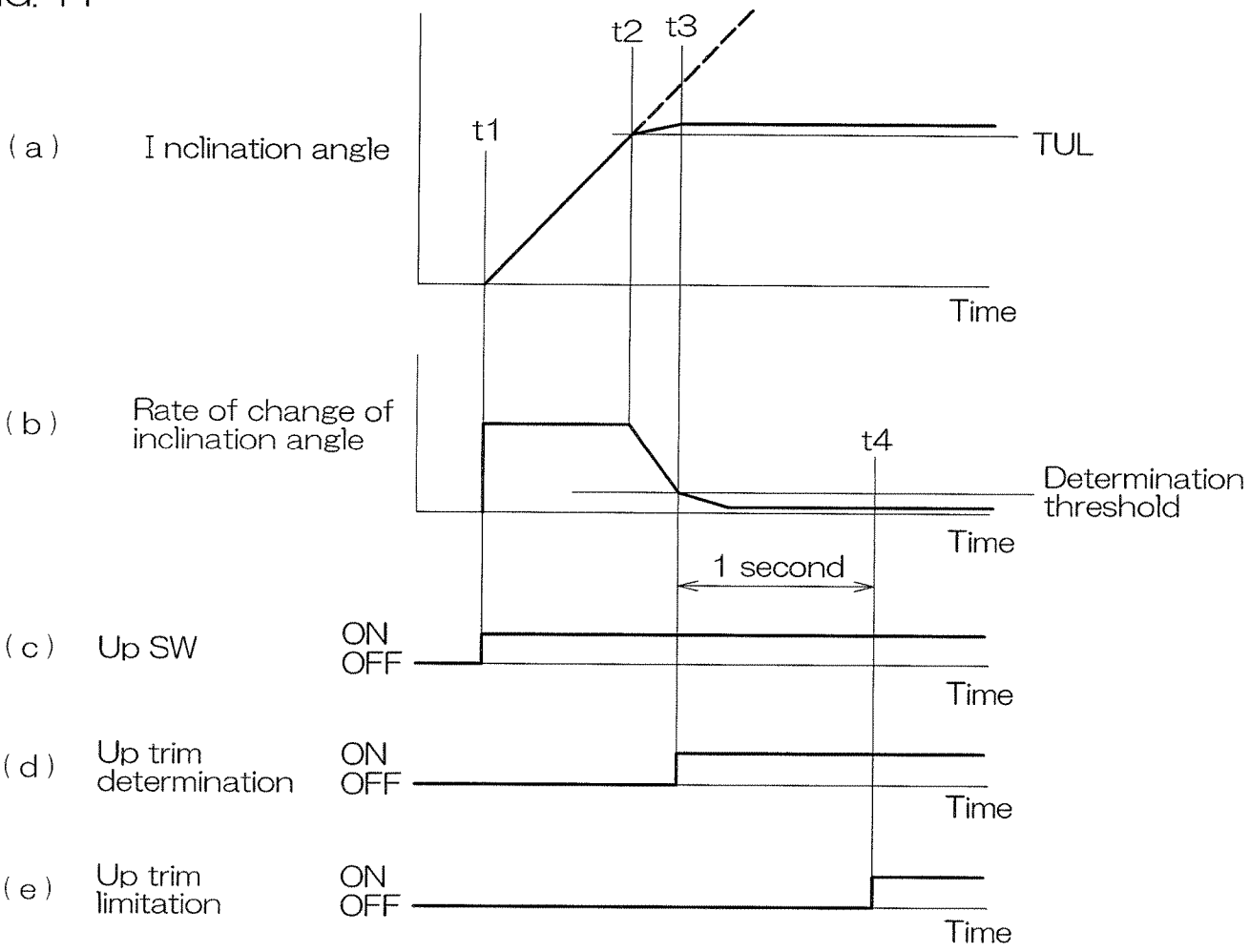
FIG. 11 is a time chart showing an example of an up trim limiting operation.

FIG. 11 is a time chart showing an operation example of up energization control limitation including an operation example when an operator operates the up switch 141 during traveling of the vessel 1. FIG. 11(*a*) shows a temporal change in the inclination angle of the outboard motor main body 7. FIG. 11(*b*) shows a temporal change in the rate of change of the inclination angle. FIG. 11(*c*) shows a change in the operation state of the up switch 141. FIG. 11(*d*) shows a change of the up trim relief determination flag. FIG. 11(*e*) shows a change of the up trim limitation flag.

By operating the up switch 141 at a time t1, the electric motor M1 is driven to rotate forward. Accordingly, the hydraulic oil is supplied to the tilt cylinder 36 and the trim cylinders 35, and the tilt rod 41 and the trim rods 39 extend. Accordingly, an inclination angle detected by the inclination angle sensor 37 increases. In a case in which the inclination angle increases linearly, the rate of change of the inclination angle is a substantially constant positive value. The trim cylinders 35 have large diameters, so that the trim rods 39 extend against a load caused by a reaction force applied to the outboard motor main body 7 from the surrounding water, and during this time, the hydraulic pressure does not reach an opening operation pressure of the up relief valve 55.

When the inclination angle reaches the upper limit boundary value TUL of the trim range 101 at a time t2, the trim rods 39 move into maximally extending states, so that the hydraulic oil does not flow into the trim cylinders 35, but flows exclusively into the tilt cylinder 36. However, the tilt cylinder 36 having a small diameter is not able to extend the tilt rod 41 against the load applied to the outboard motor main body 7 during traveling. Therefore, the hydraulic pressure in the oil passage L11 increases, and after the time t2, the up relief valve 55 opens. Therefore, the hydraulic oil that is fed out from the hydraulic pump 51 by the electric motor M1 passes through the up relief valve 55 and flows into the bypass oil passage L21, and is fed to the reserve tank 52. This state is held, so that the inclination angle becomes substantially fixed at a value near the upper limit boundary value TUL of the trim range.

By continuing the operation of the up switch 141, a continuous application time of a forward drive current reaches a predetermined time (for example, about 1 second) or longer, and moreover, changes in the inclination angle slow down and reach a determination threshold or less, and accordingly, the up trim relief determination flag is turned on at a time t3. When a duration time of this state reaches a predetermined duration of time (for example, about 1 second), the up trim limitation flag is turned on at a time t4, supply of the forward drive current is stopped, and the up energization control is limited (stopped). In this way, when the outboard motor main body 7 is trimmed up to the vicinity of the upper limit boundary value TUL of the trim range 101, the electric motor M1 is quickly stopped.

An operation relating to limitation of down energization control is also basically the same. That is, when the down switch 142 is operated, the electric motor M1 drives the hydraulic pump 51 in reverse. Accordingly, until the lower limit boundary value LL of the trim range 101 is reached, the tilt rod 41 and the trim rods 39 contract; however, after the lower limit boundary value LL is reached, the hydraulic oil does not flow into the tilt cylinder 36 or the trim cylinders 35. Therefore, the hydraulic pressure in the oil passage L12 increases, and the down relief valve 56 opens.

Because of this mechanical limit, the inclination angle does not become smaller than the lower limit boundary value LL of the trim range 101, so that the rate of change of the inclination angle decreases and reaches the determination threshold or less. Accordingly, the ECU 20 stops application of a reverse drive current to the electric motor M1 to limit (stop) the down energization control. In this way, when the outboard motor main body 7 is trimmed down/tilted down to the lower limit of the trim range 101, the electric motor M1 is quickly stopped.

Thus, according to the present preferred embodiment, in response to an operator operating the PTT operation switch 14, the electric motor M1 is energized, and the trim cylinders 35 and the tilt cylinder 36 are actuated. Accordingly, the outboard motor main body 7 turns around the tilt shaft 13, and the inclination angle of the outboard motor main body 7 changes. The inclination angle is detected by the inclination angle sensor 37. When a magnitude of a rate of change of the inclination angle is equal to or less than the predetermined determination threshold for a predetermined duration of time, the ECU 20 limits energization of the electric motor M1. Accordingly, when the load to incline the outboard motor main body 7 is high and the inclination angle of the outboard motor main body 7 is not able to be substantially changed, energization of the electric motor M1 is limited.

The magnitude of the rate of change of the inclination angle becomes a value that reflects a variation in the load applied to the outboard motor main body 7 during traveling of the vessel 1, the turning resistance of the swivel bracket 10 with respect to the clamp brackets 11, etc., and accurately reflects an actual load applied to the electric motor M1. In addition, the rate of change of the inclination angle is accurately obtained, and does not involve large errors unlike in the case of current measurement. Thus, an arrangement to measure measurement is not necessary. Therefore, energization of the electric motor M1 is reliably limited as necessary with an inexpensive structure.

In a preferred embodiment of the present invention, based on a condition that an inclination angle detected by the inclination angle sensor 37 is at a value within an energization limiting region determined in advance, that is, within the up trim limiting region 103 or the down trim limiting region 104, energization limiting control is performed. Accordingly, energization of the electric motor M1 is more properly limited.

The up trim limiting region 103 includes a region near the upper limit boundary value TUL of the trim range 101, and includes a portion of the trim range 101. The down trim limiting region 104 includes a region near the lower limit boundary value LL of the trim range 101, and includes a portion of the trim range 101. Therefore, when a state in which the magnitude of the rate of change of the inclination angle is small continues near the boundary values TUL and LL of the trim range 101, energization of the electric motor M1 is limited. Accordingly, proper limited energization near the boundary values TUL and LL of the trim range 101 is possible, and the electric motor M1 is prevented from being held in a high-load state for a long period of time.

In particular, in the up trim limiting region 103, energization limiting control based on the rate of change of the inclination angle is performed, and accordingly, the inclination angle of the outboard motor main body 7 is increased by trim adjustment during traveling of the vessel 1, and when a high-load state of the electric motor M1 continues, energization of the electric motor M1 is limited.

In a preferred embodiment of the present invention, the thermal breaker 49 is interposed in the power supply line 48 of the electric motor M1. The thermal breaker 49 includes a thermosensitive body (for example, a bimetal member) that is raised in temperature and deformed by high electric power being continuously supplied to the electric motor M1, and a contact that shuts off a power supply path in response to the deformation of the thermosensitive body. When the thermal breaker 49 is once actuated, the power supply path is not able to be recovered until the thermosensitive body cools. In this preferred embodiment, when a high-load state of the electric motor M1 continues, energization of the electric motor M1 is limited, so that actuation of the thermal breaker 49 is avoided. Therefore, a state in which energization of the electric motor M1 is possible, that is, a state in which the thermal breaker 49 closes the circuit, is able to be maintained.

In a preferred embodiment of the present invention, when loads on the hydraulic cylinders 35 and 36 exceed a predetermined value, the bypass oil passages L21 and L22 that bypass the hydraulic cylinders 35 and 36 are opened by the relief valves 55 and 56. When the electric motor M1 is continuously operated in this state, not only electric power is wasted, but the electric motor M1 is also continuously driven in a high-load state. On the other hand, due to opening of the relief valves 55 and 56, the hydraulic cylinders 35 and 36 are not able to generate a driving force, so that the inclination angle of the outboard motor main body 7 does not substantially change. Accordingly, energization of the electric motor M1 is limited, so that the electric motor M1 is prevented from being held in a high-load state for a long period of time.

Figure 12:
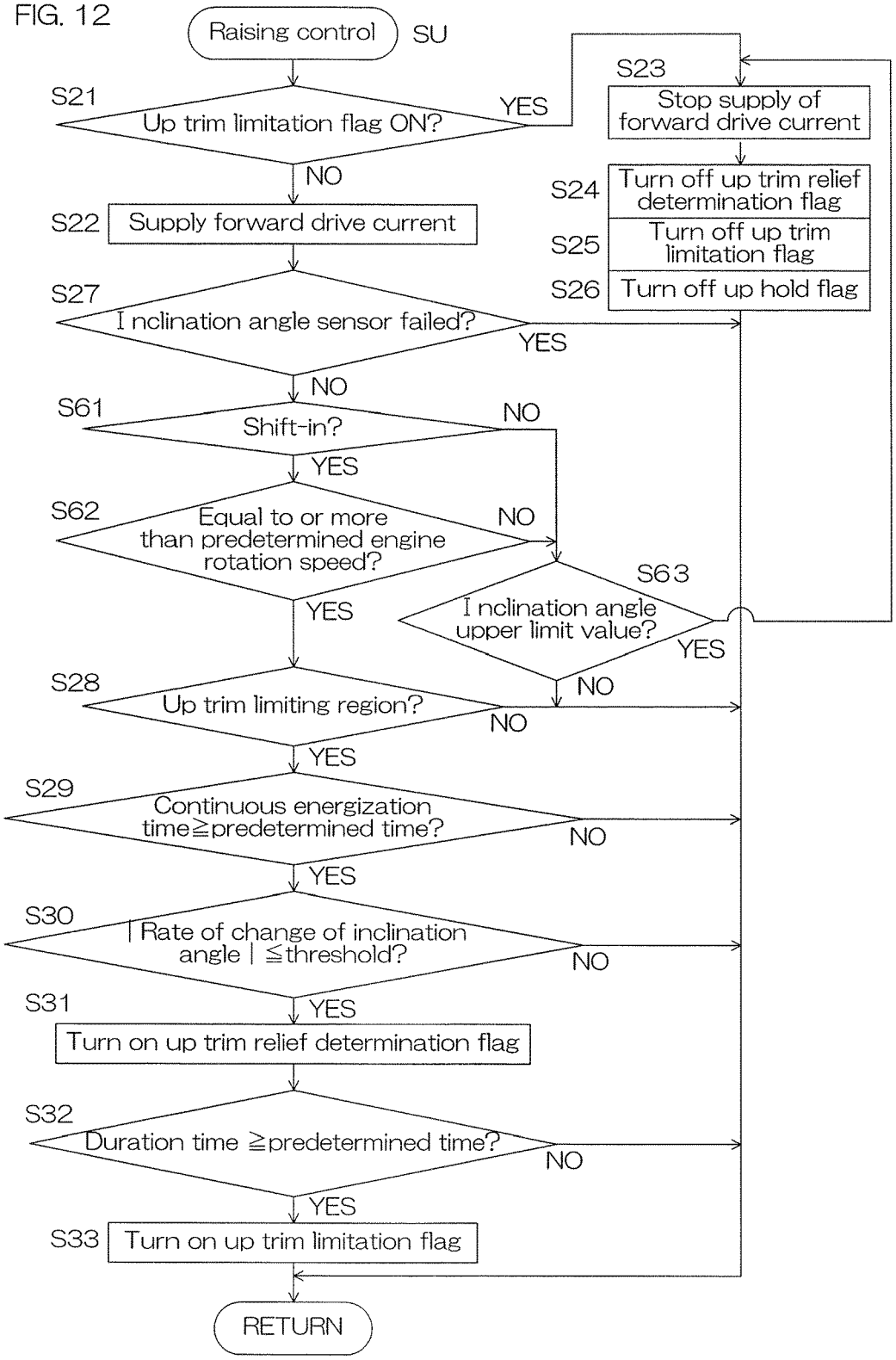
FIG. 12 is a flowchart to describe another preferred embodiment of the present invention, showing another example of a raising control.
Figure 13:
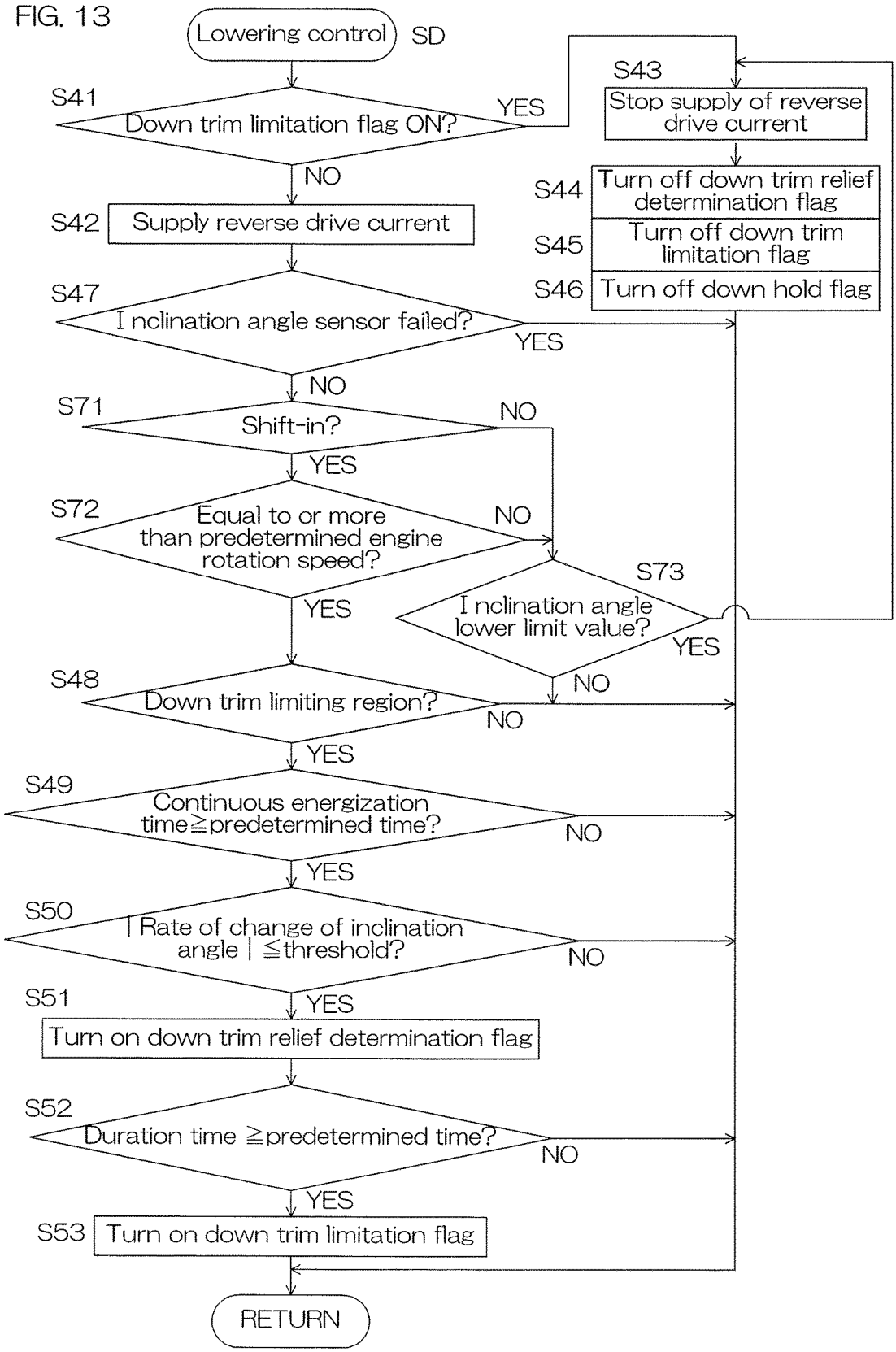
FIG. 13 is a flowchart to describe another preferred embodiment of the present invention, showing another example of a lowering control.

FIG. 12 and FIG. 13 are flowcharts to describe another preferred embodiment of the present invention. In the description of this preferred embodiment, FIG. 1 to FIG. 7 described above are referred to again. FIG. 12 shows another example of the raising control SU described above, and FIG. 13 shows another example of the lowering control SD described above. In FIG. 12 and FIG. 13, steps that are the same as the steps shown in FIG. 9 or FIG. 10 described above are designated by the same reference signs.

In the present preferred embodiment, the ECU 20 judges whether it is in a shift-in state based on a shift position signal of the shift position detector 34 (Step S61, S71). That is, whether the shift position of the forward-reverse switching mechanism 19 is at the neutral position is judged. When the shift position is at the forward position or the reverse position, it is in a shift-in state. When the shift position is at the neutral position, it is in a shift-out state. In the shift-in state, the ECU 20 further judges whether the engine rotation speed is equal to or more than a predetermined threshold (for example, about 5000 rpm) (Step S62, S72). When the engine rotation speed is equal to or more than the threshold in the shift-in state, the propeller 18 generates a propulsive force, and the output of the engine 15 is high. Therefore, a large propulsive force is generated, and in response to this, the outboard motor main body 7 is subjected to a large reaction force from the surrounding water. Therefore, when the outboard motor main body 7 rises, there is a high possibility that the up relief valve 55 is opened near the upper limit boundary value TUL of the trim range 101. At the time of lowering of the outboard motor main body 7, when the lower limit boundary value LL is reached, the down relief valve 56 is opened. Then, the ECU 20 performs the processes of Steps S28 to S33 during the raising control SU and Steps S48 to S53 during the lowering control SD. Accordingly, when the rate of change of the inclination angle decreases in the up trim limiting region 103 and the down trim limiting region 104, the ECU 20 turns on the up trim limitation flag or the down trim limitation flag and stops energization of the electric motor M1.

In the shift-out state (Step S61, S71: YES) and when the engine rotation speed is less than the threshold (Step S62, S72: NO), the ECU 20 skips the processes of Steps S28 to S33 and S48 to S53, and judges whether the inclination angle detected by the inclination angle sensor 37 has reached the upper limit value UL or the lower limit value LL (Step S63, S73). When the result of this judgment is affirmative, the process is ended. When the inclination angle has not reached the upper limit value UL or the lower limit value LL (Step S63, S73: NO), the ECU 20 continues energization of the electric motor M1. Accordingly, the hydraulic pump 51 is driven and the tilt cylinder 36 (and the trim cylinders 35) raises or lowers the outboard motor main body 7.

As described above, according to the present preferred embodiment, the forward-reverse switching mechanism 19 being in the shift-in state is a condition of performing the energization limiting control. In the shift-in state, that is, when power of the engine 15 is transmitted to the propeller 18, a lager external force is applied to the outboard motor main body 7 due to a reaction force from the surrounding water. Accordingly, the load on the electric motor M1 increases. Therefore, by making it a condition that it is in the shift-in state, energization limiting control based on the rate of change of the inclination angle is properly performed.

In a preferred embodiment of the present invention, a condition to perform the energization limiting control is that the output of the engine 15, that is, the engine rotation speed is equal to or more than a predetermined value. When the output of the engine 15 is large, a large propulsive force is generated, and accordingly, a large reaction force is applied to the outboard motor main body 7 from the surrounding water. Accordingly, the load on the electric motor M1 is high. Therefore, by making it a condition that the engine rotation speed is equal to or more than a predetermined value, energization limiting control based on the rate of change of the inclination angle is properly performed.

It is also possible to omit the shift-in condition in Steps S61 and S71 by further modifying the present preferred embodiment. The engine rotation speed condition in Steps S62 and S72 may also be omitted. For example, it is possible that the description relating to the engine rotation speed condition in Steps S62 and S72 is provided in the program executed by the processor 201, and by setting the threshold relating to the engine rotation speed to 0 rpm, the engine rotation speed condition may be substantially invalidated.

It is also possible that, only during the raising control SU, the shift-in condition and/or the engine rotation speed condition is introduced, and in the lowering control SD, the same control (refer to FIG. 10) as in the first preferred embodiment described above may be performed.

While detailed preferred embodiments of the present invention are described above, the present invention can be further carried out by other preferred embodiments.

For example, the PTT operation switch 14 may not include the full up switch 143 and the full down switch 144. To the contrary, the PTT operation switch 14 may not include the up switch 141 and the down switch 142.

It is possible that the up hold flag is turned on when the up switch 141 is held down for a predetermined period of time or longer. Similarly, it is also possible that the down hold flag is turned on when the down switch 142 is held down for a predetermined period of time or longer.

In a preferred embodiment of the present invention described above, application of a forward drive current is preferably stopped when the up trim limitation flag is turned on; however, it is also possible that the current value of the forward drive current is limited to a predetermined low current value. Similarly, it is also possible that a current value of a reverse drive current is limited to a predetermined low current value when the down trim limitation flag is turned on.

In a preferred embodiment of the present invention described above, based on a condition that the inclination angle of the outboard motor main body 7 is at a value within the trim limiting region 103 or 104, energization limiting control based on the rate of change of the inclination angle is performed. However, in the entire trim range 101 and tilt range 102, energization limiting control based on the rate of change of the inclination angle may be performed. However, for example, due to an increase in mechanical turning resistance, the speed of tilt-up/tilt-down may become lower. In this case, if the outboard motor main body 7 is tilted up above the surface of the water or tilted down below the surface of the water even though the load becomes slightly high, the outboard motor 2 is still able to be used. Therefore, by setting the trim limiting regions 103 and 104 to reasonable regions, energization of the electric motor M1 is properly limited without impairing the usability of the outboard motor 2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor main body;

a mount that includes a fixed member to be fixed to a hull and a tilt shaft joined to the fixed member, and that attaches the outboard motor main body to the hull such that the outboard motor main body is turnable around the tilt shaft;

a turning mechanism that turns the outboard motor main body around the tilt shaft to incline the outboard motor main body with respect to the fixed member;

an electric actuator that supplies a driving force to the turning mechanism;

an inclination angle sensor that detects an inclination angle of the outboard motor main body with respect to the fixed member; and a controller that is configured or programmed to actuate the turning mechanism by energizing the electric actuator in response to an operation switch that is operated by an operator to change the inclination angle, and perform energization limiting control to limit energization of the electric actuator when a magnitude of a rate of change of the inclination angle detected by the inclination angle sensor is equal to or less than a predetermined determination threshold for a predetermined duration of time.

2. The outboard motor according to claim 1, wherein the controller is configured or programmed to perform the energization limiting control based on a condition that the inclination angle detected by the inclination angle sensor is at a value within an energization limiting region determined in advance.

3. The outboard motor according to claim 2, wherein the energization limiting region includes a region near a boundary value of a trim range determined in advance.

4. The outboard motor according to claim 3, wherein the energization limiting region includes a portion of the trim range defined between an upper limit boundary value and a lower limit boundary value.

5. The outboard motor according to claim 4, wherein the energization limiting region includes an up trim limiting region of not less than a first intermediate value between the upper limit boundary value and the lower limit boundary value.

6. The outboard motor according to claim 4, wherein the energization limiting region includes a down trim limiting region of not more than a second intermediate value between the upper limit boundary value and the lower limit boundary value.

7. The outboard motor according to claim 1, wherein the controller is configured or programmed to energize the electric actuator while the operation switch is operated.

8. The outboard motor according to claim 1, wherein the controller is configured or programmed to, when the operation switch is operated, continue energization of the electric actuator even after the operation of the operation switch ends.

9. The outboard motor according to claim 1, wherein the operation switch includes an up switch to increase the inclination angle and a down switch to reduce the inclination angle; and the controller is configured or programmed to perform up energization control to energize the electric actuator so as to increase the inclination angle when the up switch is operated, and perform down energization control to energize the electric actuator so as to reduce the inclination angle when the down switch is operated.

10. The outboard motor according to claim 1, further comprising a thermal breaker interposed in a power supply path of the electric actuator.

11. The outboard motor according to claim 1, wherein the outboard motor main body includes a drive source, a propulsive force generator, and a clutch to turn on/off power transmission between the drive source and the propulsive force generator; and the controller is configured or programmed to perform the energization limiting control based on a condition that the clutch is on.

12. The outboard motor according to claim 1, wherein the controller is configured or programmed to perform the energization limiting control based on a condition that an output of a drive source of the outboard motor main body is equal to or more than a predetermined value.

13. The outboard motor according to claim 1, wherein the electric actuator includes an electric motor and a hydraulic pump to be driven by the electric motor; and the turning mechanism includes a hydraulic cylinder to be supplied with hydraulic oil from the hydraulic pump, and a relief valve that opens a bypass oil passage that bypasses the hydraulic cylinder when a load on the hydraulic cylinder exceeds a predetermined value.

14. A vessel comprising:

a hull;

an operation switch to be operated by an operator to change the inclination angle; and the outboard motor according to claim 1 attached to the hull.

* * * * *